US010167162B2

(12) United States Patent
Hiratsuka et al.

(10) Patent No.: US 10,167,162 B2
(45) Date of Patent: Jan. 1, 2019

(54) MEDIUM STORAGE DEVICE AND MEDIUM TRANSACTION DEVICE

(71) Applicant: Oki Electric Industry Co., Ltd., Tokyo (JP)

(72) Inventors: Shuuichi Hiratsuka, Tokyo (JP); Hajime Togiya, Tokyo (JP); Kazuhiro Hosokawa, Tokyo (JP); Wataru Wakushima, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/567,322

(22) PCT Filed: Jan. 7, 2016

(86) PCT No.: PCT/JP2016/050349
§ 371 (c)(1),
(2) Date: Oct. 17, 2017

(87) PCT Pub. No.: WO2016/174879
PCT Pub. Date: Nov. 3, 2016

(65) Prior Publication Data

US 2018/0111783 A1 Apr. 26, 2018

(30) Foreign Application Priority Data

Apr. 28, 2015 (JP) ..... 2015-091916

(51) Int. Cl.
*B65H 31/20* (2006.01)
*B65H 1/04* (2006.01)
(Continued)

(52) U.S. Cl.
CPC ..... *B65H 31/20* (2013.01); *B65H 1/04* (2013.01); *B65H 1/266* (2013.01); *B65H 31/10* (2013.01);
(Continued)

(58) Field of Classification Search
CPC ..... B65H 1/04; B65H 1/266; B65H 2511/10; B65H 2511/12; B65H 2511/11;
(Continued)

(56) References Cited

U.S. PATENT DOCUMENTS 7,484,728 B2 * 2/2009 Yonemoto ..... B65H 1/04 271/144
9,858,743 B2 * 1/2018 Wakabayashi ..... G07D 11/0006
2015/0291381 A1 10/2015 Komatsu

FOREIGN PATENT DOCUMENTS

JP 02095628 A * 4/1990
JP H08-231109 A 9/1996
(Continued)

*Primary Examiner* — Luis A Gonzalez
(74) *Attorney, Agent, or Firm* — Rabin & Berdo, P.C.

(57) ABSTRACT

In a banknote storage box (16) of an ATM (1), a front guide (25) is attached to a front door (21) through attachment members (26) at four locations in a front guide attachment section (30). Intervals between faces (32 and 33) positioned on mutually opposite sides of each attachment member (26) are different for each of three attachment intervals LA, LB, and LC. Accordingly, in the front guide attachment section (30), a selected attachment interval LS is able to be adjusted between three steps without exchanging components by just changing the orientation of each attachment member (26) when attaching the attachment member (26).

7 Claims, 25 Drawing Sheets

(51) Int. Cl.

| | |
|---|---|
| ***B65H 1/26*** | (2006.01) |
| ***G07D 9/00*** | (2006.01) |
| ***G07D 11/00*** | (2006.01) |
| ***G07F 19/00*** | (2006.01) |
| ***B65H 31/10*** | (2006.01) |
| ***B65H 83/02*** | (2006.01) |

(52) U.S. Cl.
CPC ..... *B65H 83/025* (2013.01); *G07D 9/00* (2013.01); *G07D 11/009* (2013.01); *G07D 11/0012* (2013.01); *G07F 19/202* (2013.01); *B65H 2402/61* (2013.01); *B65H 2701/1912* (2013.01)

(58) Field of Classification Search
CPC ..... B65H 31/20; B65H 2701/1912; G07D 11/0006; G07D 11/0012; G07D 11/0021; G07D 11/0027; G07D 11/0081
See application file for complete search history.

(56) References Cited

FOREIGN PATENT DOCUMENTS

| | | | |
|---|---|---|---|
| JP | 2014-098997 | A | 5/2014 |
| WO | WO-2010/064310 | A1 | 6/2010 |
| WO | WO-2014/077050 | A1 | 5/2014 |

* cited by examiner

FIG.9B

T1

| | | FIXED-TO PORTION (STEP INTERVAL LT) | | | | | | |
|---|---|---|---|---|---|---|---|---|
| | | S0 | S1 | S2 | S3 | S4 | S5 | S6 |
| SELECTED ATTACHMENT INTERVAL LS | LA | LA | LA + 1 | LA + 2 | LA + 3 | LA + 4 | LA + 5 | LA + 6 |
| | LB = LA + 7 | LA + 7 | LA + 8 | LA + 9 | LA + 10 | LA + 11 | LA + 12 | LA + 13 |
| | LC = LA + 14 | LA + 14 | LA + 15 | LA + 16 | LA + 17 | LA + 18 | LA + 19 | LA + 20 |

FIG.14B

T2

| | | | FIXED-TO PORTION (STEP INTERVAL LT) | | | |
|---|---|---|---|---|---|---|
| | | | S0 | S1 | S2 | S3 |
| SELECTED ATTACHMENT INTERVAL LS | FIRST ATTACHMENT MEMBER | LA | LA | LA + 1 | LA + 2 | LA + 3 |
| | | LB = LA + 4 | LA + 4 | LA + 5 | LA + 6 | LA + 7 |
| | | LC = LA + 8 | LA + 8 | LA + 9 | LA + 10 | LA + 11 |
| | SECOND ATTACHMENT MEMBER | LD = LA + 12 | LA + 12 | LA + 13 | LA + 14 | LA + 15 |
| | | LE = LA + 16 | LA + 16 | LA + 17 | LA + 18 | LA + 19 |
| | | LF = LA + 20 | LA + 20 | LA + 21 | LA + 22 | LA + 23 |

MEDIUM STORAGE DEVICE AND MEDIUM TRANSACTION DEVICE

TECHNICAL FIELD

The present invention relates to a medium storage device and a medium transaction device, and is suitably applied, for example, to an automatic teller machine (ATM) that is inserted with a medium, such as banknotes, by a customer and performs a desired transaction.

BACKGROUND ART

ATMs and the like, for example into which a customer pays in cash such as banknotes and coins, and that pay out cash to a customer according to the contents of a transaction with the customer, are widely employed in financial institutions and the like.

For example, ATMs have been proposed including a banknote pay-in/pay-out port that exchanges banknotes with a customer, a classification section that classifies the inserted banknotes by denomination and authenticity, a temporary holding section that temporarily holds inserted banknotes, and banknote storage boxes that store banknotes by denomination.

In such an ATM, during a pay-in transaction, when banknotes are inserted into the banknote pay-in/pay-out port by a customer, the inserted banknotes are classified by the classification section, and banknotes classified as normal banknotes are stored in the temporary holding section, and banknotes classified as being unsuitable for transaction are placed back in the banknote pay-in/pay-out port and returned to the customer. The ATM then confirms the amount to be deposited by the customer, feeds out the banknotes stored in the temporary holding section for the classification section to reclassify the denomination, and stores each of the banknotes in the banknote storage boxes according to their classified denomination.

Of these, there are banknote storage boxes that, for example, include a storage space for internally storing banknotes and a discharge mechanism that discharges banknotes into the storage space. These banknote storage boxes are configured to discharge banknotes from the discharge mechanism into a discharge space and neatly stack banknotes in a state with their sheet faces facing up and down.

In such a banknote storage box, the size of a stacking space, specifically, the front-rear direction and left-right direction lengths, are each configured slightly longer than the respective lengths of the short edge and the long edge of a banknote such that a gap of an appropriate distance can be formed around the banknotes and make it possible for banknotes to be neatly stacked inside the storage space. However, the size of banknotes generally differs depending on the issuing country or region, as well as the denomination.

To address this, a banknote storage box has been proposed (for example, see Japanese Patent Application Laid-Open (JP-A) No. 2014-98997 (FIG. 33 and FIG. 34)) in which a defining component that defines a banknote stacking region is attached to the inside of the banknote storage box, and the attachment position of this attachment component is changed to change the size of the storage space, enabling banknotes of various sizes to be accommodated.

SUMMARY OF INVENTION

Technical Problem

However, in the banknote storage box described above, the defining component is, for example, attached through a component called a collar to a casing or the like of the banknote storage box by an attachment screw. Accordingly, when changing the size of the storage space in the banknote storage box, there is a need to prepare a collar and an attachment screw of a dedicated length for each desired size.

Namely, when changing the type of banknote stored in the banknote storage box, it is necessary to exchange collars and attachment screws in accordance with the size of the banknotes, requiring man-hours for such exchange operations, and also incurring the effort of preparing and managing plural types of collars and attachment screws.

In consideration of the above circumstances, the present invention proposes a medium storage device and a medium transaction device in which the size of a space that stores a medium is able to be easily and precisely adjusted.

Solution to Problem

A medium storage device of the present invention addressing the above issue includes a base body, a defining body that defines a size in a predetermined defined direction of a storage space for storing a medium, and an attachment member that attaches the defining body to the base body. The attachment member includes plural base body fixing portions that are fixable to the base body, and plural defining body fixing portions that are provided at positions separated from the respective base body fixing portions by mutually different attachment intervals in mutually different attachment directions, and that are fixable to the defining body. In the attachment member, one of the base body fixing portions, and the defining body fixing portion provided on the attachment direction side of this base body fixing portion, are respectively fixed to the base body and the defining body.

A medium transaction device of the present invention includes a conveyance section that conveys a medium that is transacted with a user, and a medium storage device that stores the medium conveyed by the conveyance section. The medium storage device includes a base body, a defining body that defines a size in a predetermined defined direction of a storage space for storing the medium, and an attachment member that attaches the defining body to the base body. The attachment member is provided with plural base body fixing portions that are fixable to the base body, and plural defining body fixing portions that are provided at positions separated from the respective base body fixing portions by mutually different attachment intervals in mutually different attachment directions, and that are fixable to the defining body. In the attachment member, one of the base body fixing portions, and the defining body fixing portion provided on the attachment direction side of this base body fixing portion, are respectively fixed to the base body and the defining body.

The present invention enables the attachment position of the defining body in the defined direction with respect to the base body to be adjusted without exchanging the attachment member by changing the orientation of the attachment member, and then fixing the base body fixing portion to the base body and fixing the defining body fixing portion to the defining body.

Advantageous Effects of Invention

The present invention enables the realization of a medium storage device and a medium transaction device in which the size of a space that stores a medium is able to be easily and precisely adjusted.

BRIEF DESCRIPTION OF DRAWINGS

FIG. 9B is a diagram illustrating an attachment position adjustment table T1 of attachment positions of the front guide in FIG. 9A.

FIG. 14B is a diagram illustrating an attachment position adjustment table T2 of attachment positions of the front guide in FIG. 14A.

DESCRIPTION OF EMBODIMENTS

Explanation follows regarding embodiments for implementing the present invention (referred to below as exemplary embodiments), with reference to the drawings.

1. First Exemplary Embodiment

1-1. ATM and Banknote Pay-in/Pay-Out Device Configuration

Figure 1:
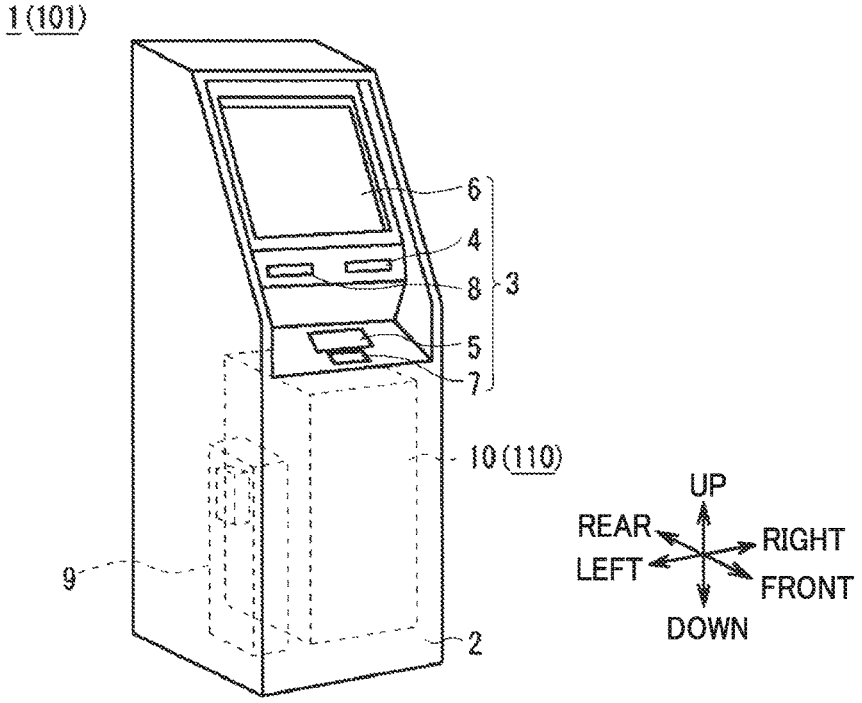
FIG. 1 is a schematic perspective view illustrating external configuration of an ATM.

As illustrated in the external view of FIG. 1, an ATM 1 is configured around a box shaped casing 2, and is installed, for example, in a financial institution to perform cash transactions such as pay-in transactions and pay-out transactions with a user (namely, a customer of the financial institution).

The casing 2 is provided with a customer interface 3 at a location enabling easy banknote insertion, easy operation of a touch panel, and the like by a customer facing the front side of the casing 2. The customer interface 3 is provided with a card insertion/removal port 4, a pay-in/pay-out port 5, an operation and display section 6, a ten-key 7, and a receipt issue port 8. The customer interface 3 directly handles cash and passbook transactions with the customer, for example, and notifies transaction-related information and receives operation instructions.

The card insertion/removal port 4 is a section for insertion and return of various cards, such as cash cards. A card processor (not illustrated in the drawings) that reads, for example, account numbers magnetically recorded on the various cards is provided inside casing of the card insertion/removal port 4. The pay-in/pay-out port 5 includes an openable and closable shutter, and is a section into which banknotes for paying in are inserted by a customer, and where banknotes for paying out to a customer are dispensed.

The operation and display section 6 is a touch panel integrating a liquid-crystal display (LCD) that displays operation screens during transactions, and a touch sensor that is input with, for example, a transaction type selection, a PIN, or a transaction amount. The ten-key 7 is a physical keypad that is input with, for example, the numbers 0 to 9. The ten-key 7 is employed during PIN and transaction amount input operations and the like. The receipt issue port 8 is a section that issues a receipt printed with transaction details and the like at the end of transaction processing. A receipt processor (not illustrated in the drawings) that prints transaction details and the like on a receipt is provided at the back of the receipt issue port 8.

In the following explanation, the front side is defined as the side of the ATM 1 that a customer faces, and the opposite side thereto is defined as the rear side. The left side, right side, upper side and lower side are respectively defined from the perspective of the left and right as seen by a customer facing the front side.

A main controller 9 that performs general control of the overall ATM 1, a banknote pay-in/pay-out device 10 that performs various processing relating to banknotes, and the like, are provided inside the casing 2. The main controller 9 is configured around a central processing unit (CPU), not illustrated in the drawings. The main controller 9 reads and executes predetermined programs from read only memory (ROM), flash memory, or the like, not illustrated in the drawings, to perform various processing such as pay-in processing and pay-out processing. The main controller 9 is provided with an internal storage section including Random Access Memory (RAM), a hard disk drive, flash memory, or the like. The storage section is stored with various information.

Figure 2:
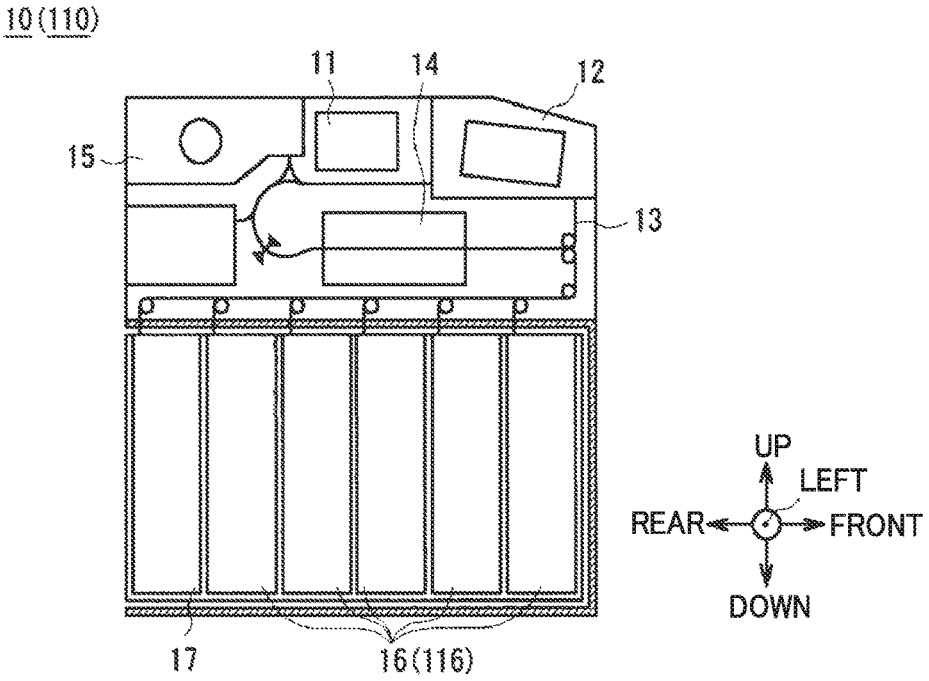
FIG. 2 is a schematic diagram illustrating configuration of a banknote pay-in/pay-out device.

As illustrated in side view in FIG. 2, the inside of the banknote pay-in/pay-out device 10 is incorporated with plural sections for performing various processing related to banknotes, serving as a medium. An upper side portion of the banknote pay-in/pay-out device 10 is provided with a banknote controller 11 performing overall control, a pay-in/pay-out section 12 that exchanges banknotes with a customer, a conveyance section 13 that conveys banknotes to the various sections, a classification section 14 that classifies banknotes, and a temporary holding section 15 that temporarily stores banknotes. A lower side portion of the banknote pay-in/pay-out device 10 is provided with banknote storage boxes 16 and a reject box 17.

The banknote controller 11 is configured around a CPU, not illustrated in the drawings, similarly to the main controller 9. The banknote controller 11 reads and executes predetermined programs from ROM, flash memory, or the like, not illustrated in the drawings, to perform various processing such as processing to control operation of the various sections. The banknote controller 11 includes an internal storage section configured by RAM, flash memory, or the like. The storage section is stored with various information.

The pay-in/pay-out section 12 is positioned at an upper front portion of the banknote pay-in/pay-out device 10. The pay-in/pay-out section 12 separates banknotes received from a customer one note at a time and passes the banknotes to the conveyance section 13. The pay-in/pay-out section 12 also stacks banknotes conveyed from the conveyance section 13 and allows a customer to take out the banknotes. Conveyance guides that guide banknotes, several rotating rollers, and the like are disposed as appropriate in the conveyance section 13, thereby forming a conveyance path for conveying the banknotes. The conveyance path is formed so as to link together the various sections inside the banknote pay-in/pay-out device 10.

The classification section 14 is positioned along the conveyance path of the banknotes. Sensors of plural types are incorporated inside the classification section 14 in order to identify the denomination, authenticity, condition (whether or not damage is present), and the like of the conveyed banknotes. Identification results are sent to the banknote controller 11. The temporary holding section 15 (FIG. 2) employs what is known as a tape escrow method, and stores banknotes by wrapping the banknotes against a circumferential side face of a circular cylinder shaped drum together with a tape, and feeds out the banknotes by peeling the tape away from the circumferential side face.

The respective banknote storage boxes 16 internally stack and store banknotes that have been determined to have a light degree of damage and to be suitable for re-use by the classification section 14 and the banknote controller 11, and that have been conveyed by the conveyance section 13 according to their denomination. On receipt of an instruction from the banknote controller 11 to feed out banknotes, the banknote storage boxes 16 separate and feed out the stacked banknotes one note at a time, and pass the banknotes to the conveyance section 13 (described in detail below).

The reject box 17 internally stores banknotes that have been determined to have a heavy degree of damage and to be unsuitable for re-use (referred to as reject banknotes) by the classification section 14 and the banknote controller 11, and have been conveyed by the conveyance section 13.

In cases in which, for example, a customer performs a pay-in transaction with the ATM 1, in coordination with the main controller 9 and the like, after receiving predetermined operation input from the operation and display section 6, the banknote controller 11 opens the shutter of the pay-in/pay-out port 5 (FIG. 1) to allow insertion of banknotes into the pay-in/pay-out section 12. When banknotes have been inserted, the pay-in/pay-out section 12 shuts the shutter of the pay-in/pay-out port 5, and then separates the banknotes one note at a time and passes the banknotes to the conveyance section 13. The conveyance section 13 conveys the received banknotes to the classification section 14 for classification, and notifies the banknote controller 11 of the obtained classification results. The banknote controller 11 decides the conveyance destination of each banknote accordingly.

When this is performed, the conveyance section 13 conveys banknotes classified by the classification section 14 as normal (referred to as normal notes) to the temporary holding section 15 where they are temporarily held. The conveyance section 13 conveys banknotes classified as unsuitable for transactions (referred to as damaged banknotes, counterfeit banknotes, or the like) to the pay-in/pay-out section 12 for returning to the customer.

The banknote controller 11 then prompts the customer to confirm the pay-in amount using the operation and display section 6 (FIG. 1), and conveys the banknotes held in the temporary holding section 15 to the classification section 14 where the banknotes are classified by denomination, degree of damage, and the like, and acquires the classification results. The banknote controller 11 then has banknotes with a heavy degree of damage conveyed to and stored in the reject box 17 as reject banknotes that are unsuitable for re-use, and has banknotes with a light degree of damage conveyed to the storage boxes 16 to be stored by denomination as banknotes suitable for re-use.

However, in cases in which, for example, a customer performs a pay-out transaction with the ATM 1, in coordination with the main controller 9 and the like, after receiving predetermined operation input from the operation and display section 6 (FIG. 1), the banknote controller 11 feeds out banknotes from the storage boxes 16 according to the amount to be paid out. The banknote controller 11 then uses the conveyance section 13 to convey the banknotes to the classification section 14 for classification, before conveying the banknotes to the pay-in/pay-out section 12 and opening the shutter of pay-in/pay-out port 5 (FIG. 1) to allow the customer to take out the banknotes.

1-2. Configuration of Banknote Storage Boxes

Figure 3:
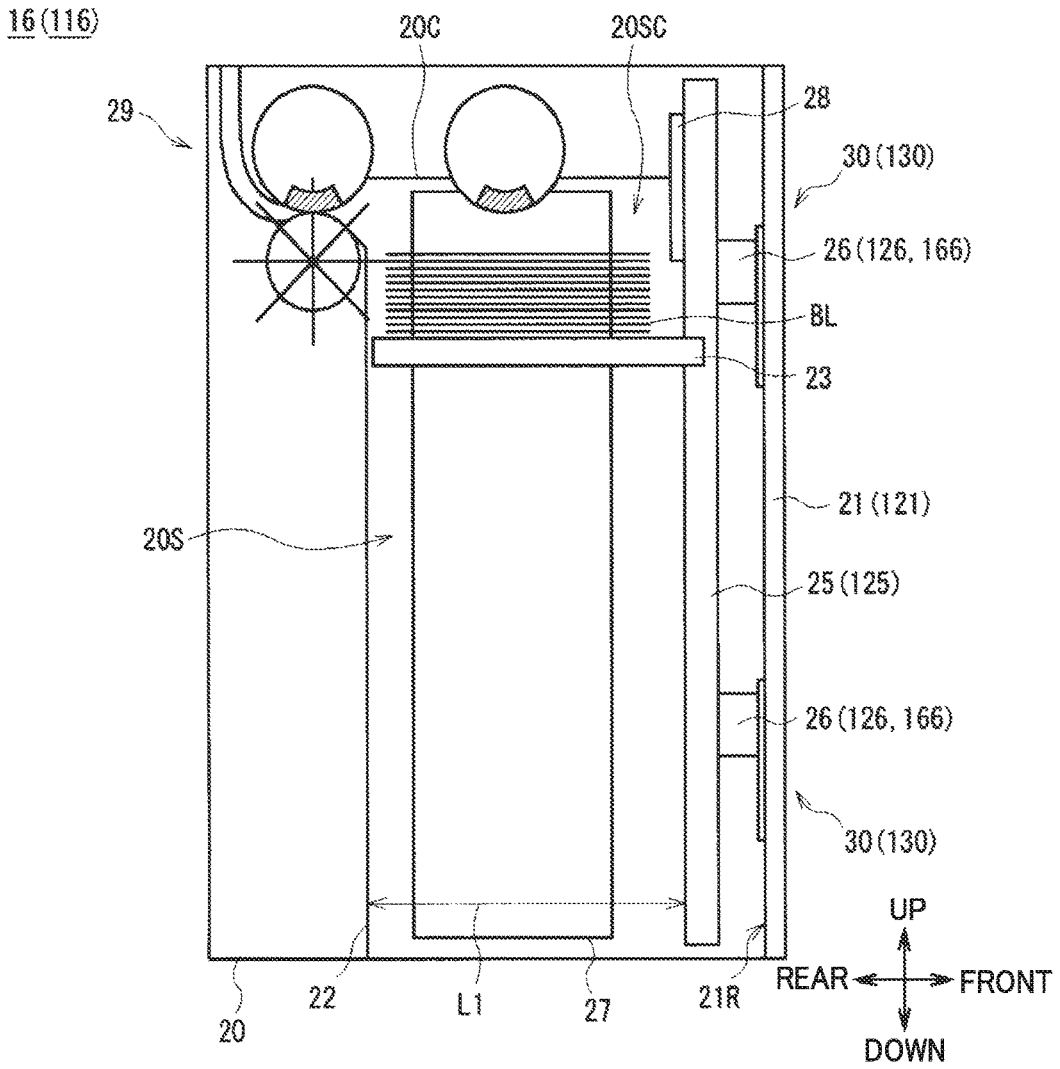
FIG. 3 is a schematic diagram illustrating configuration of a banknote storage box.

As illustrated in schematic side view in FIG. 3, the banknote storage boxes 16 are configured in overall rectangular block shapes, and internally store banknotes serving as a medium.

Each banknote storage box 16 is configured by a casing 20 forming respective left, right, upper, lower, and rear side faces, and by a front door 21, this being a front side face. The front door 21 is attached to the casing 20 by a hinge, not illustrated in the drawings, so as to be openable and closable. A reverse guide 22 is provided toward the rear inside the casing 20. The reverse guide 22 partitions the front and rear of the space inside the casing 20, forming an internal space 20S to the front side of the reverse guide 22.

A stage 23 having an upper face upon which banknotes BL are placed is provided inside the internal space 20S. The stage 23 is formed in a plate shape with a substantially horizontally disposed plate face, and is driven by a stage drive section, not illustrated in the drawings. The stage drive section drives the stage 23 in the up-down direction, and stops the stage 23 at a desired height (position in the up-down direction). An upper edge of the internal space 20S is defined by a top plate 20C provided slightly below an upper side plate of the casing 20.

A front guide 25 that guides banknotes is provided at the front side of the internal space 20S, namely to a rear face 21R side of the front door 21. A front-rear length L1, this being the interval between the reverse guide 22 and the front guide 25, is adjusted to a desired length by attaching the front guide 25 to the front door 21 through attachment members 26 (explained in detail below).

Side guides 27 that guide banknotes are respectively provided in the vicinity of left and right inside faces within the internal space 20S. The side guides 27 are attached to respective left and right side plates through position adjustment mechanisms, not illustrated in the drawings. Thus, by using the position adjustment mechanisms to move the respective side guides 27 in the left-right direction, the respective left-right direction positions are adjusted to adjust the interval between the side guides 27 to a desired length.

A rectangular box shaped space slightly smaller than the internal space 20S defined by the upper side of the stage 23, the top plate 20C, the reverse guide 22, the front guide 25, and the respective left and right side guides 27 is thus formed inside the internal space 20S. Banknotes are sequentially stacked and stored on the stage 23 in this space. This space is referred to as the storage space 20SC below. Thus, the front-rear direction (also referred to below as the defined direction) size of the storage space 20SC is defined by the position at which the front guide 25 is attached to the front door 21 (this position is referred to below as the attachment position).

A bill stopper 28 is provided at the upper front of the storage space 20SC, namely in the vicinity of an upper end of a rear face of the front guide 25. The bill stopper 28 is formed in a small rectangular block shape, and is attached to the front guide 25 through an elastic body, not illustrated in the drawings.

A separation and discharge section 29 configured by an assembly of plural rollers and guides is provided to a portion toward the top of the rear side of the internal space 20S. The separation and discharge section 29 rotates each roller as appropriate so as to discharge banknotes received from the conveyance section 13 (FIG. 2) into the storage space 20SC, stack the banknotes on the stage 23, and store the banknotes. Additionally, the separation and discharge section 29 rotates each roller as appropriate so as to separate and feed out banknotes stacked on the stage 23 one note at a time, and sequentially passes the banknotes to the conveyance section 13 (FIG. 2).

Thus, in each of the banknote storage boxes 16, the front guide 25 is attached to the rear face 21F of the front door 21 through the attachment members 26, and the front face of the storage space 20SC is defined by the front guide 25.

1-3. Configuration of the Front Guide Attachment Section

Next, explanation follows regarding configuration of the front door 21, the front guide 25, and the attachment members 26. As schematically illustrated in the exploded perspective view of FIG. 4, the front guide 25, serving as a defining body, is attached to the front door 21 through four of the attachment members 26. The four attachment members 26 are spaced apart from each other, and are disposed in columns of two in the up-down direction and in rows of two in the left-right direction. Note that the front door 21, the front guide 25, and the attachment member 26 are all configured by a resin material.

The front guide 25 has a shape in which two plate shaped members that are thin in the front-rear direction and long and slender in the up-down direction are coupled together from left to right in the vicinity of upper and lower end portions. Front guide fixing portions 50 for fixing the attachment members 26 are provided to the front guide 25 at four locations, namely, provided so as to be aligned at two locations in the left-right direction and at two locations in the up-down direction.

A protection portion 25A that is formed long and slender in a downward direction is provided in the vicinity of the lower end of the front guide 25 at each of the left and right outermost portions thereof. An extension portion 25B that is similarly formed long and slender in a downward direction is provided to the inside of each of the left and right protection portions 25A. Additionally, engagement hooks 25C that project outward towards the left and right are formed to lower ends of the extension portions 25B. The engagement hooks 25C are capable of elastic deformation in the left-right direction due to the properties of the extension portions 25B configured by a resin material.

The front door 21, serving as a base body, is formed in a plate shape with a larger surface area than that of the front guide 25. Front door fixing portions 40 for fixing the attachment members 26 are provided to the front door 21 at four locations. Engagement rails 21A are formed to both left and right sides of a front face of the front door 21 in the vicinity of the lower end thereof, at locations corresponding to the engagement hooks 25C of the front guide 25. The engagement rails 21A are formed in straight line shapes running along the front-rear direction. When the front guide 25 is attached to the front door 21 through the attachment members 26, the engagement hooks 25C engage with the engagement rails 21A of the front door 21 (described in detail below).

In the following, for ease of explanation, the attachment members 26, the front door fixing portions 40 of the front door 21 and the front guide fixing portions 50 of the front guide 25 are also collectively referred to as a front guide attachment section 30.

1-3-1. Configuration of Attachment Members

Figure 5:
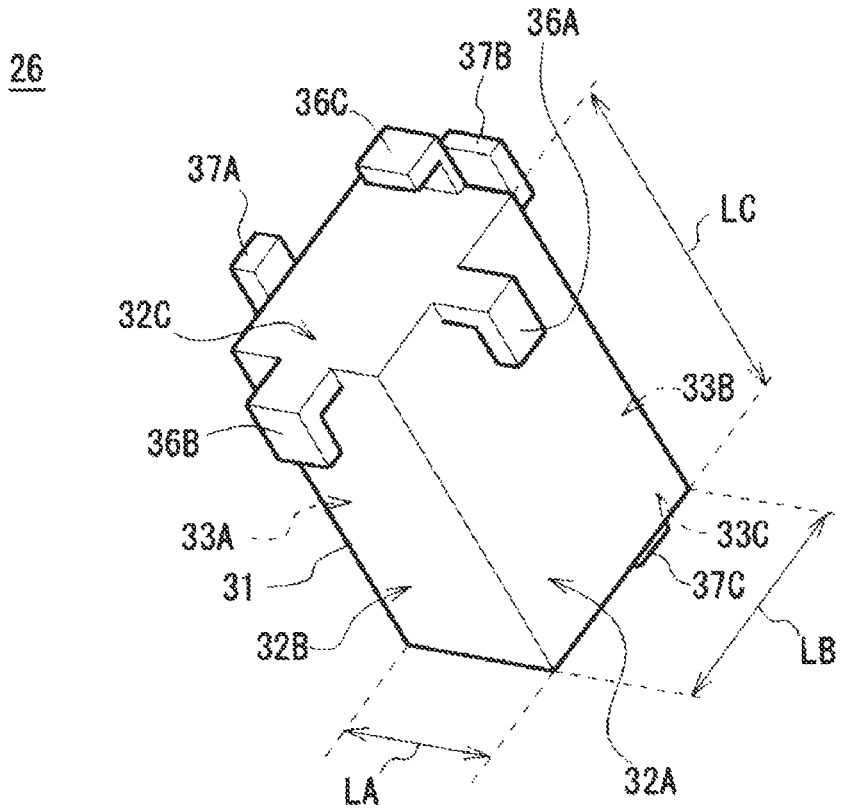
FIG. 5 is a schematic perspective view illustrating configuration of an attachment member according to the first exemplary embodiment.

As illustrated in the enlarged view of FIG. 5, each attachment member 26 is configured by a rectangular block shaped main body portion 31 and a total of six claw portions, with one claw portion provided to each face.

The main body portion 31 is configured by a face 32A and a face 33A on an opposite side thereto, a face 32B and a face 33B on an opposite side thereto, and a face 32C and a face 33C on an opposite side thereto. On the main body portion 31, an attachment interval LA, this being the interval between the face 32A and the face 33A, an attachment interval LB, this being the interval between the face 32B and the face 33B, and an attachment interval LC, this being the interval between the face 32C and the face 33C satisfy a size relationship LA<LB<LC. More specifically, LB=LA+7 mm, and LC=LB+7 mm.

In other words, the faces 33A, 33B, and 33C of the main body portion 31 of the attachment member 26 are disposed at positions separated from the respective faces 32A, 32B, and 32C by mutually different distances (namely, attachment intervals) in mutually different directions, for example, in the front-rear direction, the left-right direction, and the up-down direction.

In an orientation where the face 32C of the attachment member 26 is at the upper side, a claw portion 36A is provided in the vicinity of an upper end of the face 32A. The claw portion 36A extends from the face 32A along a normal direction thereto and bends downwards to form a hook shaped projection having an open lower side. Namely, as viewed from the left and right sides, the claw portion 36A is shaped like an English letter "L" that has been appropriately rotated or inverted. Claw portions 36B and 36C similar to the claw portion 36A are respectively provided to the faces 32B and 32C.

Similarly, in an orientation where the face 32C is at the upper side, a claw portion 37A is provided in the vicinity of an upper end of the face 33A. The claw portion 37A has substantial up-down symmetry to the claw portion 36A, and forms a hook shaped projection having an open upper side. Claw portions 37B and 37C similar to the claw portion 37A are respectively provided to the faces 33B and 33C.

Figure 6A:
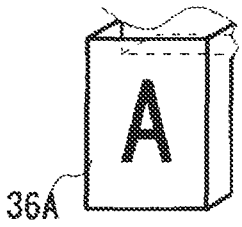
FIG. 6A is a schematic perspective view illustrating configuration of a claw portion according to the first exemplary embodiment.
Figure 6B:
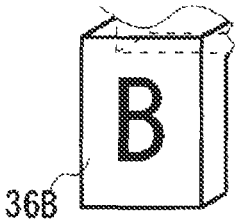
FIG. 6B is a schematic perspective view illustrating configuration of a claw portion according to the first exemplary embodiment.
Figure 6C:
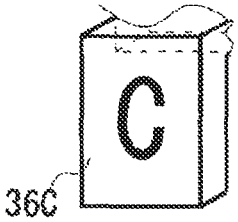
FIG. 6C is a schematic perspective view illustrating configuration of a claw portion according to the first exemplary embodiment.

Additionally, as illustrated in FIG. 6A, FIG. 6B, and FIG. 6C, the letters "A", "B", and "C" are inscribed on respective outer faces of the claw portions 36A, 36B, and 36C, namely, on portions parallel to the respective faces 32A, 32B, and 32C.

The faces 32A, 32B, and 32C provided with the claw portions 36A, 36B, and 36C, and the faces 33A, 33B, and 33C provided with the claw portions 37A, 37B, and 37C are thus disposed on mutually opposite sides of the attachment member 26, and the attachment intervals LA, LB, and LC, these being the intervals between each pair of faces, are different to each other.

1-3-2. Configuration of Front Door Fixing Portions and Front Guide Fixing Portions As illustrated in the enlarged perspective view of FIG. 7A, each front door fixing portion 40 of the front door 21 is configured around a mounting portion 41 formed by raising a portion of the rear face 21R toward the rear. A rear face of the mounting portion 41 is formed as a flat plane face.

Figure 8A:
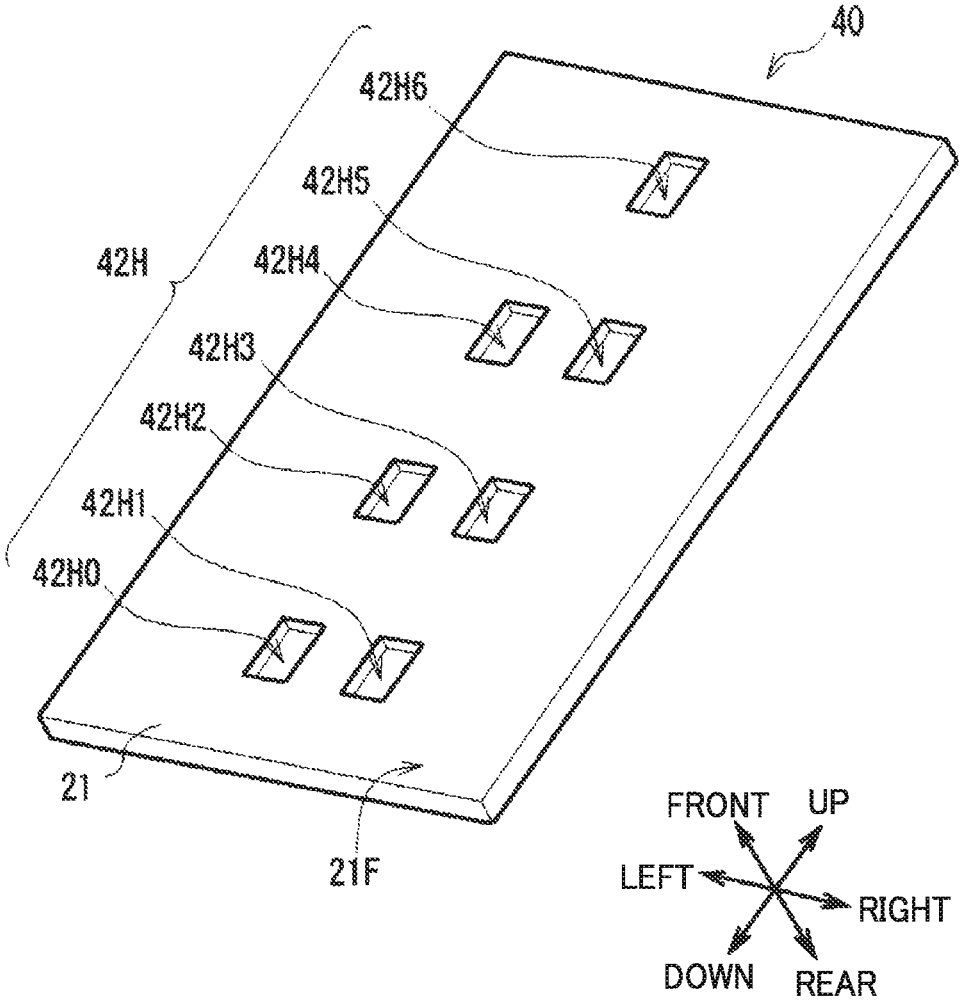
FIG. 8A is a schematic perspective view illustrating configuration of a front door fixing portion according to the first exemplary embodiment.

Seven angular fixing holes 42H (42H0, 42H1, 42H2, 42H3, 42H4, 42H5, and 42H6) are provided in the mounting portion 41. As illustrated in FIG. 8A, each fixing hole 42H penetrates to the front face 21F of the front door 21.

Further, in the following, the fixing holes 42H and peripheral portions thereof on the mounting portion 41 (FIG. 7A) are referred to as fixed-to portions 41S (41S0, 41S1, 41S2, 41S3, 41S4, 41S5, and 41S6). Of these, the fixed-to portions 41S0, 41S1, 41S2, 41S3, 41S4, and 41S5 are regularly disposed in two columns on the left and right and in three rows from top to bottom. The fixed-to portion 41S6 is disposed at the substantial center of the upper side of these fixed-to portions. Further, the fixed-to portions 41S are all provided to the rear face of the mounting portion 41, and thus all have the same position in the front-rear direction.

Figure 7A:
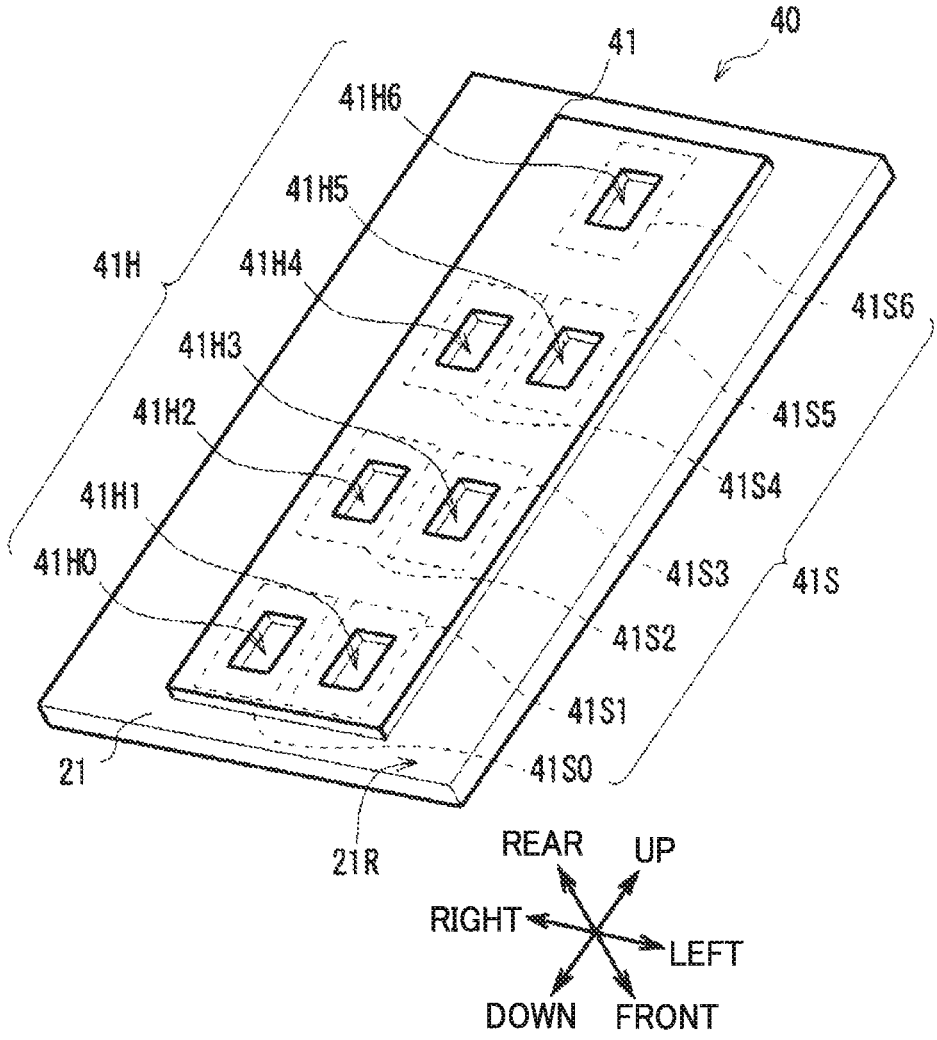
FIG. 7A is a schematic perspective view illustrating configuration of a front door fixing portion and a front guide fixing portion according to the first exemplary embodiment.
Figure 7B:
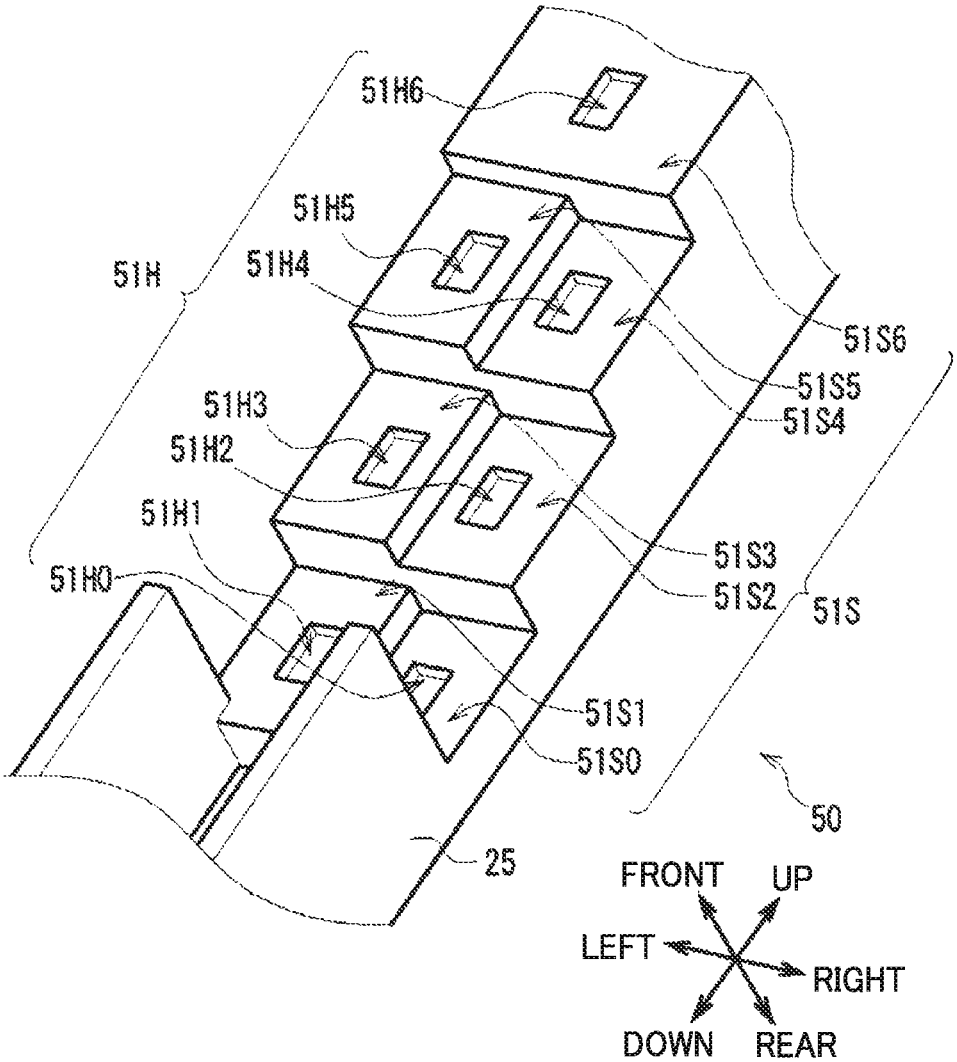
FIG. 7B is a schematic perspective view illustrating configuration of a front door fixing portion and a front guide fixing portion according to the first exemplary embodiment.

As illustrated in the enlarged perspective view of FIG. 7B, the front guide fixing portions 50 of the front guide 25 are each provided with seven fixed-to portions 51S (51S0, 51S1, 51S2, 51S3, 51S4, 51S5, and 51S6). The fixed-to portions 51S are disposed so as to mirror the fixed-to portions 41S on the front door fixing portions 40 (FIG. 7A) of the front door 21.

Namely, the fixed-to portions 51S0, 51S1, 51S2, 51S3, 51S4, and 51S5 are regularly disposed in two columns on the left and right and in three rows from top to bottom. The fixed-to portion 51S6 is disposed at the substantial center to the upper side of these fixed-to portions. In other words, the fixed-to portions 51S0, 51S1, 51S2, 51S3, 51S4, 51S5, and 51S6 are disposed at positions corresponding to the fixed-to portions 41S0, 41S1, 41S2, 41S3, 41S4, 41S5, and 41S6 of the respective front door fixing portion 40.

However, in contrast to the fixed-to portions 41S, front faces of the respective fixed-to portions 51S have different positions to each other in the front-rear direction. The fixed-to portions 51S form plural steps on the front face of the front guide 25. Specifically, the fixed-to portions 51S0, 51S1, 51S2, 51S3, 51S4, 51S5, and 51S6 have front-rear direction positions determined such that in this sequence, each reaches 1 mm further toward the front than the last.

The thickness (namely, the front-rear direction length) of the front guide 25 is the same at each of the fixed-to portions 51S. In other words, plural steps are also formed on the rear face of the front guide 25.

Angular fixing holes 52H (52H0, 52H1, 52H2, 52H3, 52H4, 52H5, and 52H6) are provided penetrating the respective fixed-to portions 51S in the front-rear direction. The fixing holes 52H are disposed so as to mirror the fixing holes 42H in the respective front door fixing portion 40 (FIG. 7A) of the front door 21 in the up-down direction and the left-right direction.

Thus, the front door fixing portions 40 of the front door 21 are provided with flat fixed-to portions 41S at seven locations having the same front-rear direction position, each of these being provided with a respective fixing hole 42H. In turn, the front guide fixing portions 50 of the front guide 25 are provided with fixed-to portions 51S forming steps at seven locations having different front-rear direction positions to each other, each of these being provided with a respective fixing hole 52H.

1-3-3. Attachment of Front Guide to Front Door

Figure 9A:
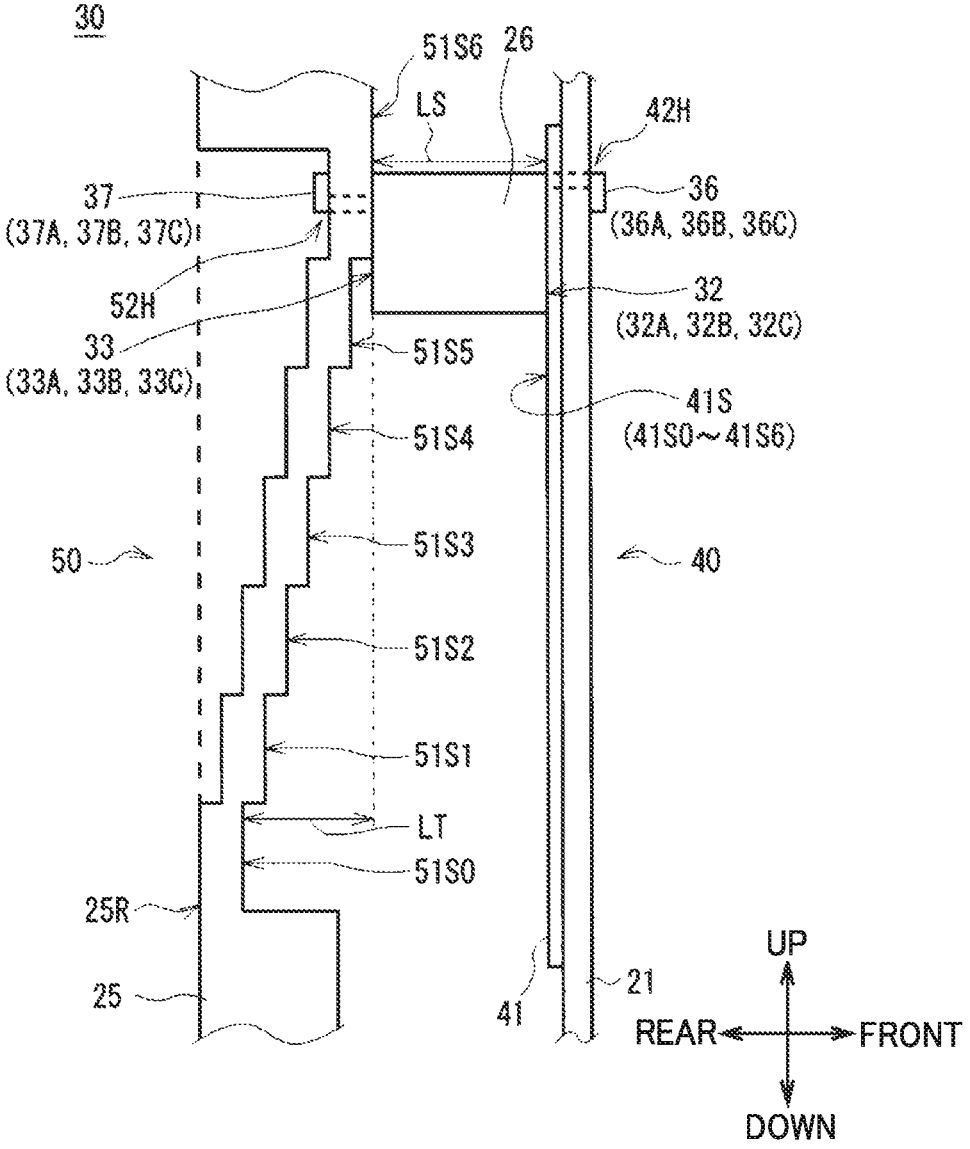
FIG. 9A is a schematic diagram illustrating an attachment position of a front guide to a front door according to the first exemplary embodiment.

Next, explanation follows regarding attachment of the front guide 25 to the front door 21 through the attachment members 26 of the front guide attachment section 30, with reference to FIG. 9A. Note that in FIG. 9A, for ease of explanation, the respective components are illustrated schematically, with some components being omitted, and the fixed-to portions 51S of the front guide 25 are aligned in a column running along the up-down direction.

In the front guide attachment section 30, first, from the rear side of the front door 21, the orientation of an attachment member 26 is adjusted as appropriate, one of the fixing holes 42H in the respective front door fixing portion 40 is selected, and a claw portion 36 of the attachment member 26 is inserted into the fixing hole 42H. Then, the attachment member 26 is moved slightly downward in a state in which a face 32 abuts a fixed-to portion 41S. The claw portion 36 is thereby hooked on the peripheral portion of the fixing hole 42H, namely the fixed-to portion 41S, fixing the attachment member 26 to the front door 21.

When this occurs, in the front guide attachment section 30, the face 32 of the attachment member 26 abuts the fixed-to portion 42S of the front door fixing portion 40 over a relatively large area, enabling sufficient force bearing even when a relatively strong force is applied in the forward direction from the attachment member 26. Further, in the front guide attachment section 30, the claw portion 36 extending downwards is inserted into the fixing hole 42 and is hooked on the fixed-to portion 41S, enabling movement of the attachment member 26 to be restricted in three directions out of the left-right direction and the up-down direction, excluding the upwards direction, these being directions intersecting the front-rear direction (namely, the defined direction).

Figure 8B:
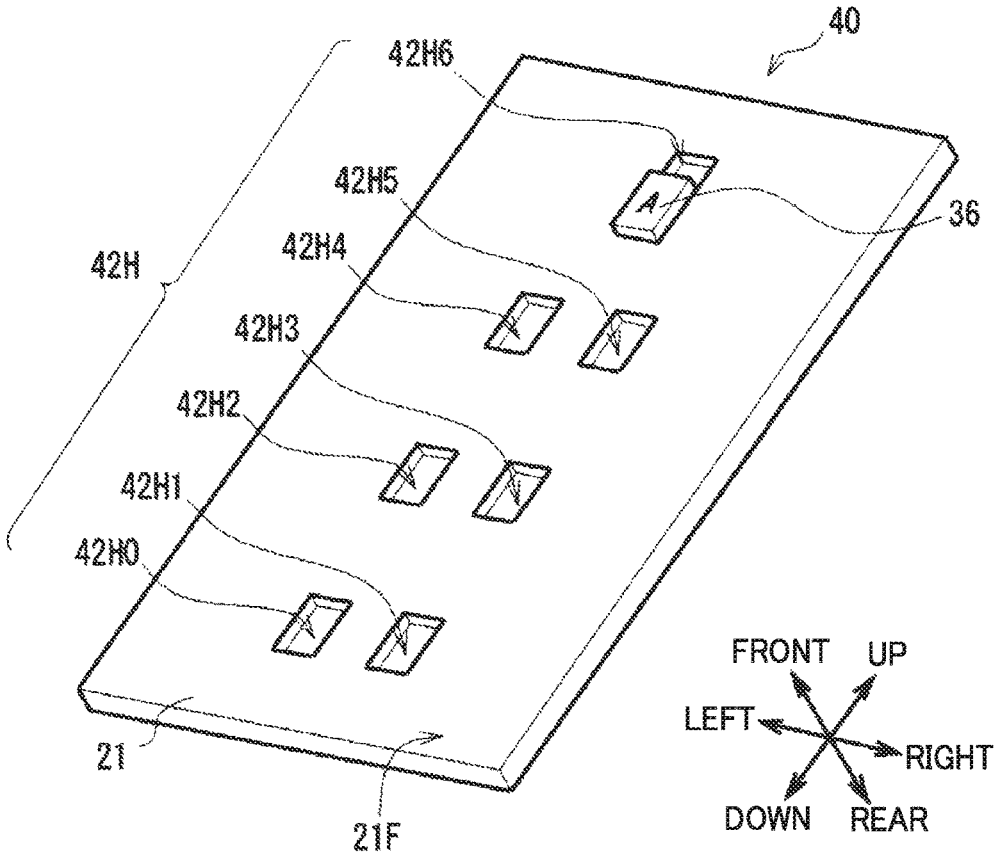
FIG. 8B is a schematic perspective view illustrating configuration of a front door fixing portion according to the first exemplary embodiment.

Further, as illustrated in FIG. 8B, a portion of the claw portion 36, specifically an outside portion, is exposed to the front side of the front door 21 through the fixing hole 42H. As illustrated in FIGS. 6A to 6C, the claw portions 36 are respectively inscribed with different letters. The front guide attachment section 30 thereby enables visual confirmation of which of the seven fixing holes 42H (42H0 to 42H6) the claw portion 36 is hooked on, and of the letter inscribed on the claw portion 36, from the front side of the front door 21, namely, from the outside of the banknote storage box 16 (FIG. 3).

Next, in the front guide attachment section 30, the front guide 25 is brought closer to the rear side of the attachment member 26, the claw portion 37 is inserted into one of the fixing holes 52H in the front guide fixing portion 50, and the front guide 25 is moved slightly downward in a state in which the face 33 of the attachment member 26 abuts the fixed-to portion 51S. The claw portion 37 is thereby hooked on the peripheral portion of the fixing hole 52H, namely the fixed-to portion 51S, then the attachment member 26 fixes the front guide 25.

Note that the attachment member 26 is fixed to the fixed-to portion 51S of the front guide fixing portion 50 corresponding to the fixed-to portion 41S to which the attachment member 26 is fixed at the front door fixing portions 40 side. For example, when the attachment member 26 is fixed to the fixed-to portion 41S0 of the front door fixing portion 40, the attachment member 26 is fixed to the fixed-to portion 51S0 of the front guide fixing portion 50.

When this is performed, as described above, movement of the front guide 25 (FIG. 4) in the up-down direction is restricted by engagement of the engagement hooks 25C with the engagement rails 21A of the front door 21. Thereby, even when an external force in the upwards direction is applied to the front guide 25, the claw portion 37 of the attachment member 26 is prevented from coming away from the fixed-to portion 51S, and the claw portion 36 of the attachment member 26 is prevented from coming away from the fixed-to portion 41S of the front door 21, and a state in which the front guide 25 is attached to the front door 21 through the attachment member 26 is maintained.

The protection portions 25A of the front guide 25 prevent foreign objects or the like from contacting the extension portions 25B from both left and right outer sides of the front guide 25, and are able to prevent the extension portion 25B from elastically deforming toward left and right inner sides and inadvertently releasing engagement of the engagement hooks 25C and the engagement rails 21A.

Figure 10A:
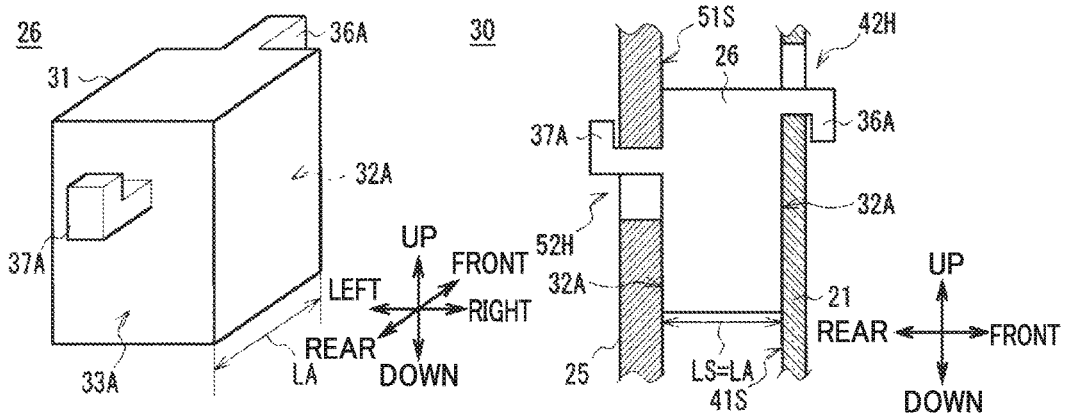
FIG. 10A is a schematic diagram illustrating a difference in an attachment interval according to the orientation of an attachment member according to the first exemplary embodiment.
Figure 10B:
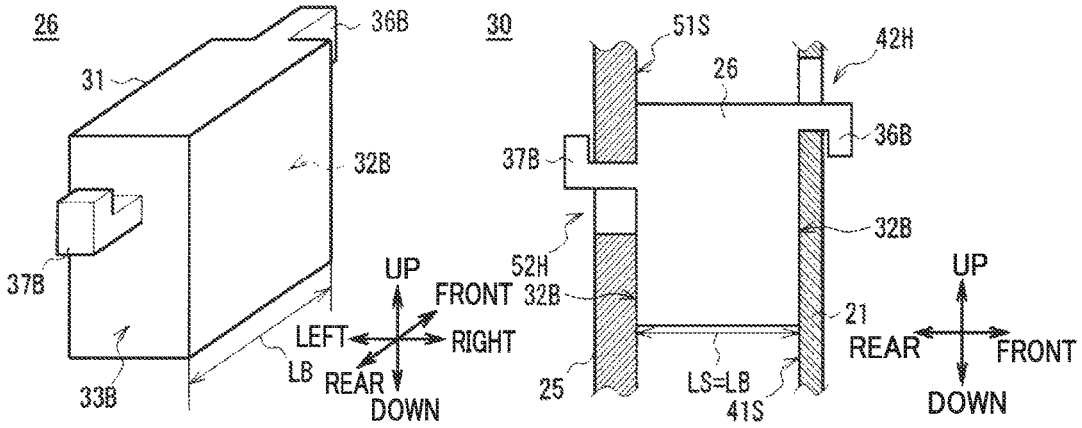
FIG. 10B is a schematic diagram illustrating a difference in an attachment interval according to the orientation of an attachment member according to the first exemplary embodiment.
Figure 10C:
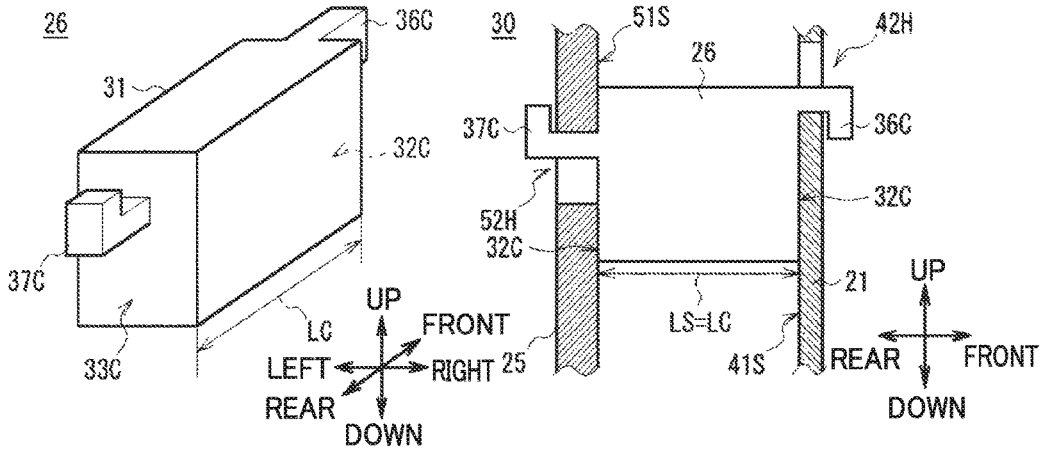
FIG. 10C is a schematic diagram illustrating a difference in an attachment interval according to the orientation of an attachment member according to the first exemplary embodiment.

As described above, the intervals between the faces positioned on mutually opposite sides of the attachment member 26 (FIG. 5), namely between the faces 32 and the faces 33, are different for each of the three attachment intervals LA, LB, and LC. Namely, as schematically illustrated in FIG. 10A, FIG. 10B, and FIG. 10C, in the front guide attachment section 30, the interval between the fixed-to portion 41S of the front door 21 and the fixed-to portion 51S of the front guide 25 (referred to below as selected attachment interval LS) can be adjusted between the three steps of the attachment intervals LA, LB, and LC according to the orientation of the attachment member 26. As described above, the selected attachment interval LS is changed in three steps in 7 mm increments.

As illustrated in in FIG. 7B and FIG. 9A, in the front guide attachment section 30, the respective fixed-to portions 51S (51S0 to 51S6) on the front guide 25 side are formed in seven steps, and so the front-rear direction position of the front guide 25 is able to be adjusted between seven steps depending on the fixed-to portion 51S to which the attachment member 26 is attached.

In the following, for ease of explanation, the front-rear direction interval to the fixed-to portion 51S (51S0 to 51S6) to which the attachment member 26 is actually attached is defined as a step interval LT, taking the fixed-to portion 51S0 positioned furthest to the front side as a point of reference. Accordingly, the step intervals LT for the fixed-to portions 51S0, 51S1, 51S2, . . . , 51S6 are 0 mm, 1 mm, 2 mm, . . . , and 6 mm, respectively.

By doing this, in the front guide attachment section 30, the front-rear direction position (referred to below as an attachment position) of the front guide 25 attached to the front door 21 through the attachment member 26 can be expressed by the summed values of the selected attachment interval LS and the step interval LT. The values of the attachment positions determined by the selected attachment interval LS corresponding to the orientation of the attachment member 26 and the selected fixed-to portion 51S can be organized and expressed as in the attachment position adjustment table T1 illustrated in FIG. 9B.

Namely, in the front guide attachment section 30, the selected attachment interval LS can be adjusted three ways, and the step interval LT can be adjusted seven ways, giving 3×7=21 ways when both are combined. In the front guide attachment section 30, the selected attachment interval LS is set in 7 mm increments, and the step interval LT is set in 1 mm increments, such that combining the two enables the attachment position of the front guide 25 to be adjusted between 21 steps of 1 mm increments over an adjustment range of 20 mm.

1-4. Advantageous Effects, etc.

In each banknote storage box 16 of the ATM 1 according to the first exemplary embodiment with the above configuration, the front guide 25 is attached to the front door 21 through the attachment members 26 at four locations in the front guide attachment section 30.

The intervals between the faces 32 and 33 positioned on mutually opposite sides of each attachment member 26 are different for each of the three attachment intervals LA, LB, and LC (FIG. 5, FIGS. 9A and 9B). Accordingly, in the front guide attachment section 30, when attaching each attachment member 26 to a respective one of the fixed-to portions 41S of a front door fixing portion 40 of the front door 21, the selected attachment interval LS is able to be adjusted between three steps just by appropriately changing the orientation of the attachment member 26, inserting a claw portion 36 (36A, 36B, or 36C) into one of the fixing holes 42H, and hooking the attachment member 26 to a fixed-to portion 41S.

Namely, in the front guide attachment section 30, there is no need to exchange the attachment members 26 for other members. The selected attachment interval LS is changed by just changing the orientation of each attachment member 26 such that one of the faces 32A, 32B, and 32C faces forward, enabling adjustment of the attachment position of the front guide 25 using the same members. Accordingly, in the front guide attachment section 30, there is no need to prepare members to be exchanged when adjusting the attachment position of the front guide 25, and the effort and the like of managing such components can also be eliminated.

Further, the positions of the respective fixed-to portions 51S in the front-rear direction are made different from each other such that the front guide fixing portions 50 of the front guide 25 are formed in steps (FIG. 7B). Accordingly, in the front guide attachment section 30, the step interval LT is able to be adjusted between seven steps (FIG. 9A) by changing the fixed-to portion 51S (51S0 to 51S6) on which a respective claw portion 37 of each attachment member 26 is hooked, and hooking and fixing a claw portion 36 to the fixed-to portion 41S (41S0 to 41S6) corresponding thereto.

Namely, in the front guide attachment section 30, there is no need to exchange the attachment members 26 with other members. The step interval LT is changed by just changing the employed fixed-to portion 41S and fixed-to portion 51S to change the attachment position of each attachment member 26, enabling adjustment of the attachment position of the front guide 25.

Additionally, in the front guide attachment section 30, by combining adjustment of the three-step selected attachment interval LS of each attachment member 26, and adjustment of the seven-step step interval LT of the front guide fixing portions 50, the attachment position of the front guide 25 is able to be adjusted between a total of 21 steps (FIG. 9B) based on the summed values of the selected attachment intervals LS and the step intervals LT.

Furthermore, in the front guide attachment section 30, the step interval LT of the front guide fixing portions 50 is changed in 1 mm increments over an adjustment range of 6 mm, and the selected attachment interval LS of the attachment member 26 is changed in 7 mm increments. Accordingly, in the front guide attachment section 30, the attachment position of the front guide 25 determined by the summed value of the step interval LT and the selected attachment interval LS is able to be adjusted in 1 mm increments from 0 mm to 20 mm.

As a result, in each banknote storage box 16, the front-rear length L1 (FIG. 3), this being the interval between the reverse guide 22 and the front guide 25, is able to be adjusted in 1 mm increments over an adjustment range of 20 mm.

For example, the lengths of the short edges of euro banknotes range from a minimum length of 62 mm (5 euros) to a maximum length of 82 mm (100 euros, for example), giving a variation of 20 mm. Correspondingly, the front-rear direction length L1 is able to be adjusted over an adjustment range of 20 mm in 1 mm increments, and so in the case of storing euro banknotes, the banknote storage boxes 16 (FIG. 3) are able to form storage spaces 20SC with sizes appropriate for denominations to be stored, and are able to neatly store the banknotes inside the respective storage space 20SC.

Moreover, in the front guide attachment section 30, the faces 32 and 33 of each attachment member 26 are provided with respective claw portions 36 and 37, and by inserting the claw portions 36 and 37 into the respective fixing holes 42H and 52H, and slightly moving the claw portions 36 and 37 in the up-down direction, the claw portions 36 and 37 are hooked on and fix to the respective fixed-to portions 41S and 51S (FIG. 8, FIG. 9A, and FIG. 9B). Accordingly, in operations to attach or operations to change the attachment position of the front guide 25, the front guide attachment section 30 enables such operations to be performed easily and in a short amount of time without requiring a worker or the like to use a tool.

Additionally, in the front guide attachment section 30, the fixing holes 42H of each front door fixing portion 40 penetrate in the front-rear direction (FIG. 7A), and outside portions of the claw portions 36 (36A, 36B, and 36C) of each attachment member 26 are respectively inscribed with mutually different letters (FIG. 6). The front guide attachment section 30 thereby enables visual confirmation of which of the fixed-to portions 41S (41S0 to 41S6) each attachment member 26 is attached to, and which respective claw portion 36 (36A to 36C) is hooked to the fixed-to portions 41S, from the front side of the front door 21.

Accordingly, in a state in which the front door 21 of a banknote storage box 16 is closed (FIG. 3), for example, the front guide attachment section 30 enables a worker or the like to identify the step interval LT and the selected attachment interval LS by sight from the front side without opening the front door 21, and enables the attachment position of the front guide 25 to be ascertained from the summed value of both intervals.

Figure 4:
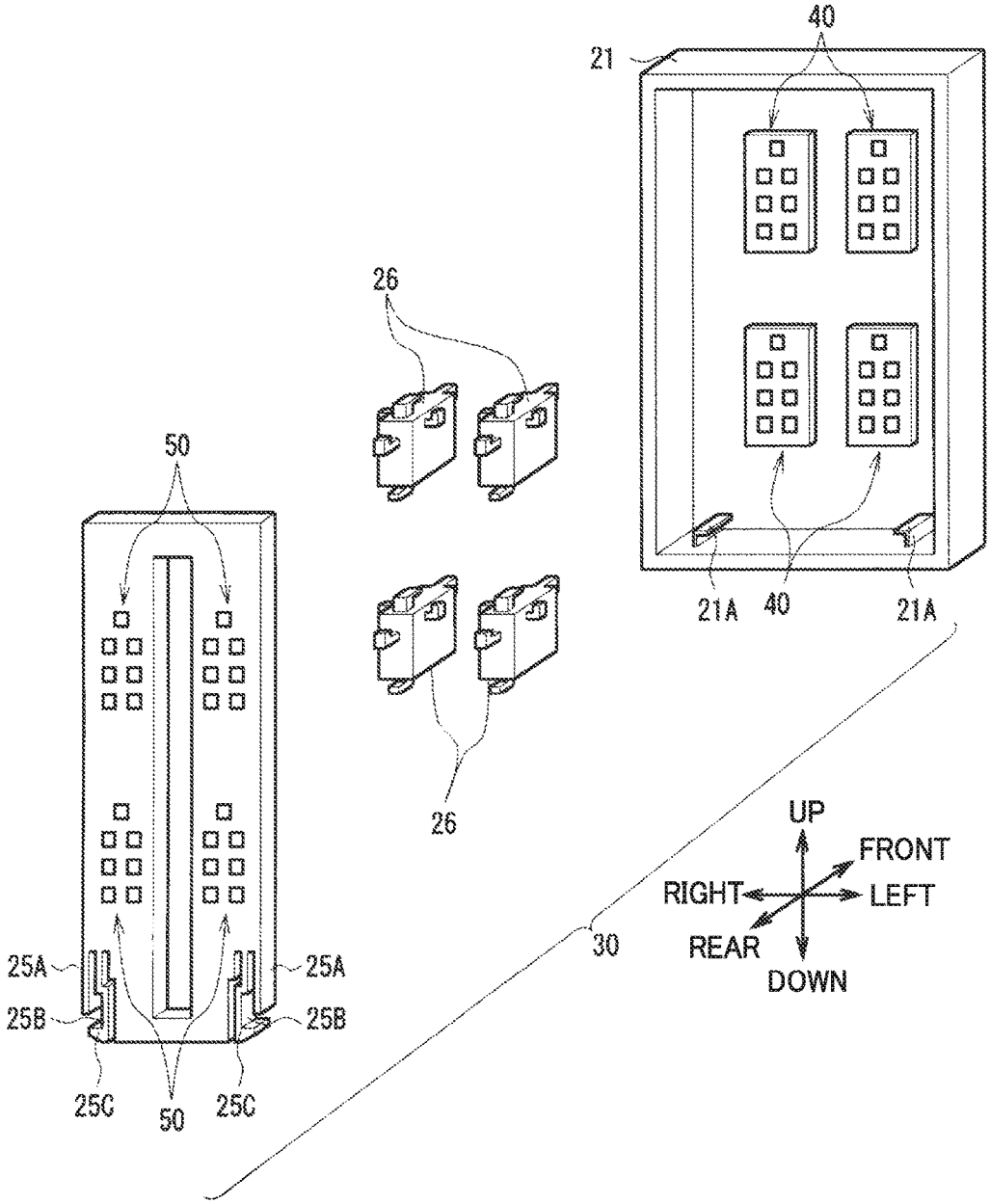
FIG. 4 is a schematic diagram illustrating configuration of a front door, a front guide, and an attachment member according to a first exemplary embodiment.

Further, in the banknote storage box 16, the front guide attachment section 30 is provided to the front door 21 and the front guide 25 at positions approximately one quarter of the way down from an upper end, and approximately one quarter of the way up from a lower end (FIG. 4). Accordingly, in the banknote storage box 16, flexure of the front guide 25 in the front-rear direction is able to be suppressed compared to a case in which the front guide 25 is provided in the vicinity of the upper end and in the vicinity of the lower end of the front guide 25.

According to the above configuration, in each banknote storage box 16 of the ATM 1 according to the first exemplary embodiment, the front guide 25 is attached to the front door 21 through the attachment members 26 at four locations in the front guide attachment section 30. The intervals between the faces 32 and 33 positioned on mutually opposite sides of the attachment members 26 are different for each of the three attachment intervals LA, LB, and LC. Accordingly, in the front guide attachment section 30, the selected attachment interval LS is able to be adjusted between three steps without exchanging components, by just changing the orientation of each attachment member 26 when the attachment member 26 is attached.

2. Second Exemplary Embodiment

An ATM 101 (FIG. 1) according to a second exemplary embodiment differs from the ATM 1 according to the first exemplary embodiment in the point that a banknote pay-in/pay-out device 110 is provided in place of the banknote pay-in/pay-out device 10, and is configured similarly in other respects. The banknote pay-in/pay-out device 110 (FIG. 2) differs from the banknote pay-in/pay-out device 10 according to the first exemplary embodiment in the point that banknote storage boxes 116 are provided in place of the banknote storage boxes 16, and is configured similarly in other respects.

The banknote storage boxes 116 (FIG. 3) differ from the banknote storage boxes 16 according to the first exemplary embodiment in the point that a front door 121 and a front guide 125 are provided in place of the front door 21 and the front guide 25, and are configured similarly in other respects. The front door 121 and the front guide 125 are respectively provided with front door fixing portions 140 and front guide fixing portions 150 in place of the front door fixing portions 40 and the front guide fixing portions 50.

Further, in the banknote storage boxes 116, either one of two types of a first attachment member 126 or a second attachment member 166 is used in place of the single type of attachment member 26. Additionally, in the banknote storage boxes 116, in place of the front guide attachment section 30, a front guide attachment section 130 is configured by the front door fixing portions 140, the front guide fixing portions 150, and the first attachment members 126 or the second attachment members 166.

2-1. Configuration of Front Guide Attachment Section

Figure 11A:
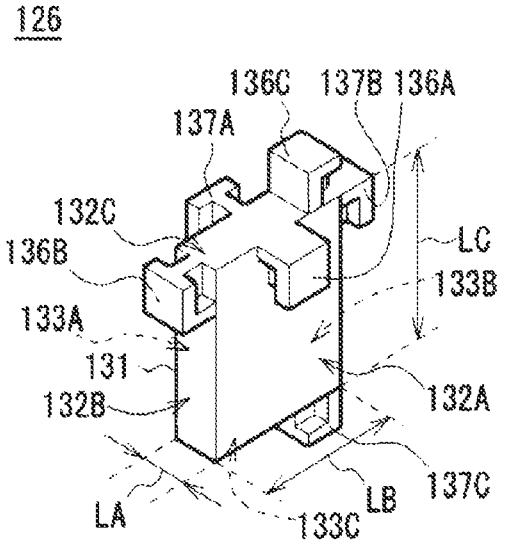
FIG. 11A is a schematic perspective view illustrating configuration of a first attachment member according to a second exemplary embodiment.
Figure 11B:
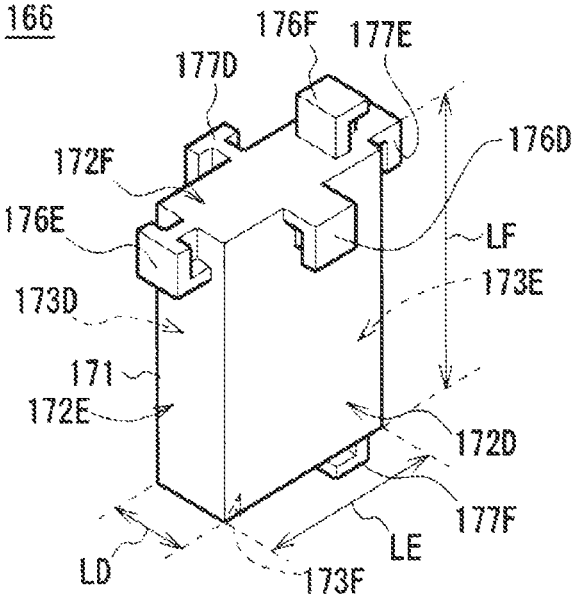
FIG. 11B is a schematic perspective view illustrating configuration of a second attachment member according to the second exemplary embodiment.

As illustrated in FIGS. 11A and 11B, corresponding to FIG. 5, similarly to the attachment member 26, each first attachment member 126 is configured by a rectangular block shaped main body portion 131 and six claw portions. Similarly to the main body portion 31, the main body portion 131 is configured by a face 132A and a face 133A on an opposite side thereto, a face 132B and a face 133B on an opposite side thereto, and a face 132C and a face 133C on an opposite side thereto.

In this exemplary embodiment, an attachment interval LA, this being the interval between the face 132A and the face 133A, an attachment interval LB, this being the interval between the face 132B and the face 133B, and an attachment interval LC, this being the interval between the face 132C and the face 133C satisfy a size relationship LA<LB<LC that is similar to that of the first exemplary embodiment. More specifically, LB=LA+4 mm, and LC=LB+4 mm.

Claw portions 136 (136A, 136B, and 136C) are provided to the faces 132 (132A, 132B, and 132C) in place of the claw portions 36. The claw portions 136 have a similar configuration to that of the claw portions 36, and are each additionally formed with a plate shaped rib substantially at the left-right direction center to link between the face 132 and a leading end portion of the claw portion 136. Claw portions 137 (137A, 137B, and 137C) are also provided to the faces 133 (133A, 133B, and 133C) in place of the claw portions 37. The claw portions 137 have substantial up-down symmetry to the claw portions 136, and are formed with ribs similarly to the claw portions 136.

Each second attachment member 166 is configured in a manner resembling the first attachment member 126, and is configured by a rectangular block shaped main body 171 and six claw portions. Similarly to the main body portion 131, the main body portion 171 is configured by a face 172D and a face 173D on an opposite side thereto, a face 172E and a face 173E on an opposite side thereto, and a face 172F and a face 173F on an opposite side thereto.

On this main body portion 171, the attachment interval LC, an attachment interval LD, this being the interval between the face 172D and the face 173D, an attachment interval LE, this being the interval between the face 172E and the face 173E, and an attachment interval LF, this being the interval between the face 172F and the face 173F satisfy a size relationship LC<LD<LE<LF. More specifically, LD=LC+4 mm, LE=LD+4 mm, and LF=LE+4 mm.

Thus, the second attachment member 166 differs from the first attachment member 126 only in the respective attachment intervals.

Figure 12A:
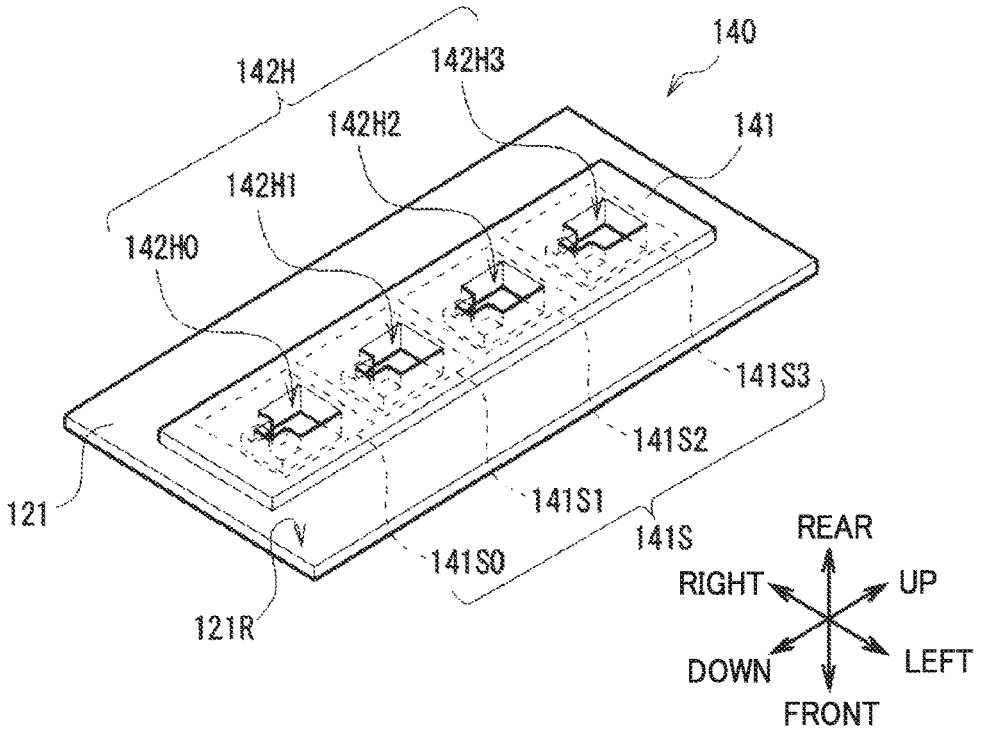
FIG. 12A is a schematic perspective view illustrating configuration of a front door fixing portion according to the second exemplary embodiment.
Figure 12B:
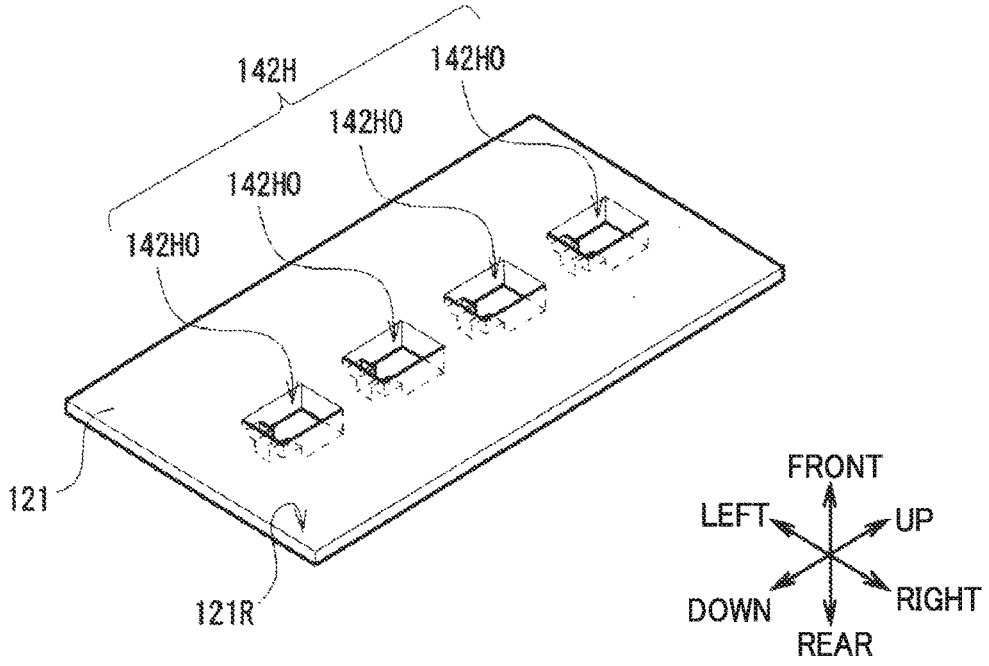
FIG. 12B is a schematic perspective view illustrating configuration of a front door fixing portion according to the second exemplary embodiment.

As illustrated in FIG. 12A and FIG. 12B, corresponding to FIG. 7A and FIG. 8A, the front door fixing portions 140 of the front door 121 are each configured around a mounting portion 141 formed by raising a portion of a rear face 121R toward the rear. A rear face of the mounting portion 141 is formed as a flat plane face. Fixed-to portions 141S (141S0, 141S1, 141S2, and 141S3) are disposed at four locations in a single column along the up-down direction on the rear face of the mounting portion 141.

Fixing holes 142H (142H0, 142H1, 142H2, and 142H3) are respectively provided to the fixed-to portions 141S in place of the fixing holes 42H. The fixing holes 142H are all angular holes that penetrate the front door 121 in the front-rear direction, and a cutout corresponding to the rib provided to the claw portions 36 and the like of the first attachment member 126 is formed at a lower edge of each of the fixing holes 142H.

Figure 13:
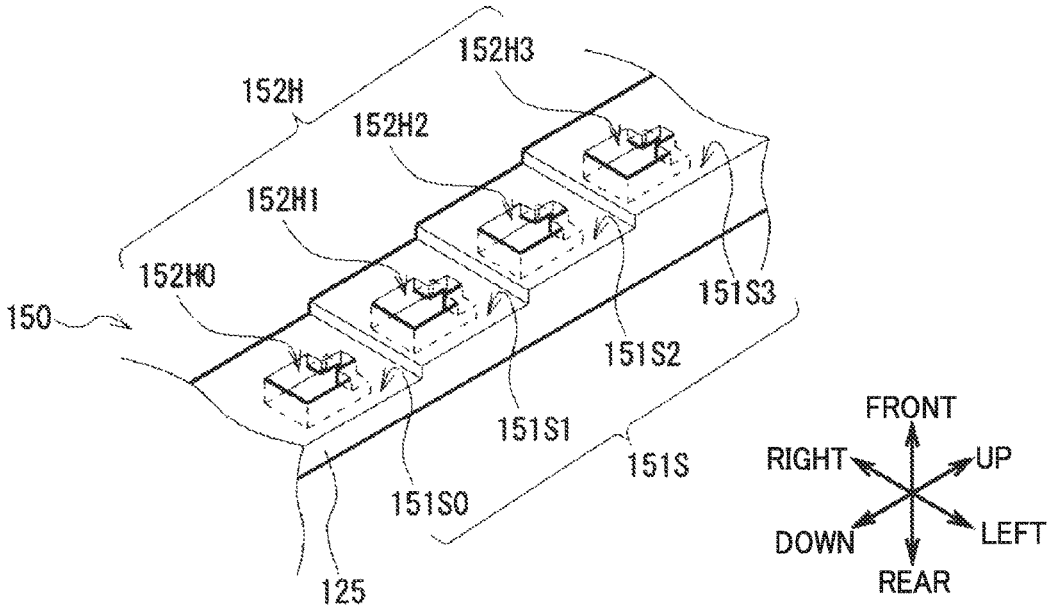
FIG. 13 is a schematic perspective view illustrating configuration of a front guide fixing portion according to the second exemplary embodiment.

As illustrated in the enlarged perspective view of FIG. 13, corresponding to FIG. 7B, each front guide fixing portion 150 of the front guide 125 is provided with four fixed-to portions 151S (151S0, 151S1, 151S2, and 151S3). Similarly to in the first exemplary embodiment, the respective fixed-to portions 151S are disposed in a single column along the up-down direction so as to mirror the respective fixed-to portions 141S on the front door fixing portions 140 (FIG. 12A) of the front door 121.

Similarly to in the first exemplary embodiment, front faces of the respective fixed-to portions 151S have different positions to each other in the front-rear direction, and the fixed-to portions 151S form plural steps on the front face of the front guide 125. Specifically, the fixed-to portions 151S0, 151S1, 151S2, and 151S3 have respective front-rear direction positions determined such that in this sequence, each reaches 1 mm further toward the front than the last.

Angular fixing holes 152H (152H0, 152H1, 152H2, and 152H3) are provided penetrating the respective fixed-to portions 151S in the front-rear direction. The respective fixing holes 152H are disposed at respective positions in the up-down direction and left-right direction corresponding to the respective fixing holes 142H in the front door fixing portion 140 (FIG. 12A) of the front door 121. The respective fixing holes 152H are all angular holes that penetrate the front guide 125 in the front-rear direction, and a cutout corresponding to the rib provided to the claw portions 37 and the like of the first attachment member 126 is formed at an upper edge of each of the fixing holes 152H.

2-2. Attachment of Front Guide to Front Door

Figure 14A:
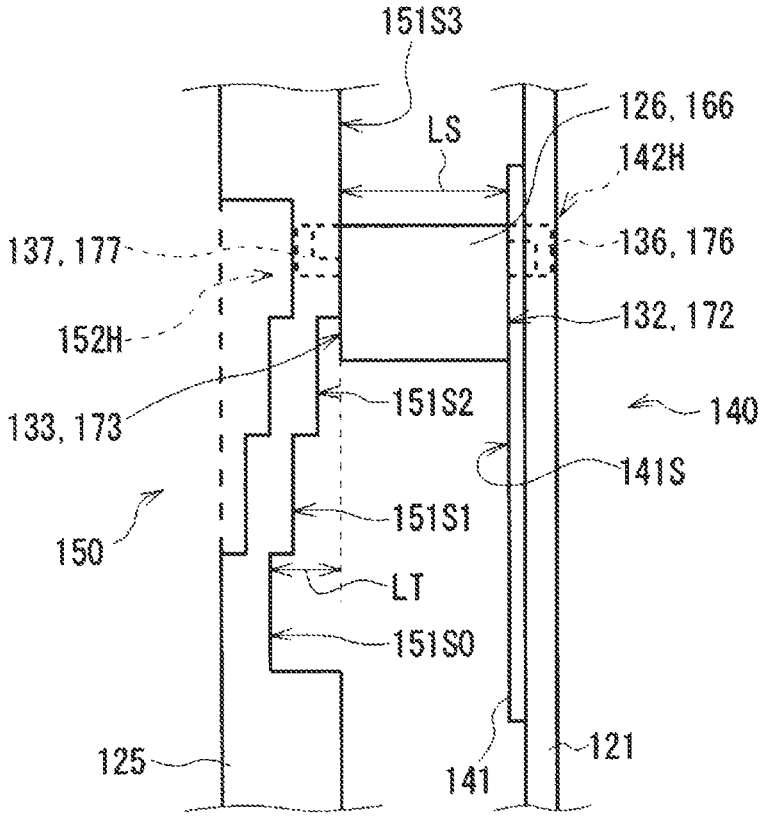
FIG. 14A is a schematic diagram illustrating an attachment position of a front guide to a front door according to the second exemplary embodiment.

As illustrated in FIG. 14A, corresponding to FIG. 9A, in the front guide attachment section 130, similarly to the first exemplary embodiment, the front guide 125 is attached to the front door 121 through either the first attachment member 126 or the second attachment member 166.

Specifically, in the front guide attachment section 130, in cases in which a first attachment member 126 is employed, after the orientation of the first attachment member 126 has been appropriately adjusted, a claw portion 136 is inserted into one of the fixing holes 142H in the respective front door fixing portion 140, and the claw portion 136 is hooked on the fixed-to portion 141S to fix the first attachment member 126 to the front door 121. Further, in the front guide attachment section 130, a claw portion 137 of the first attachment member 126 is inserted into one of the fixing holes 152H in the respective front guide fixing portion 150, and the claw portion 137 is hooked on the fixed-to portion 151S to fix the front guide 125. Note that in the front guide attachment section 130, in cases in which the second attachment member 166 is employed, the claw portions 176 and 177 are similarly hooked on the respective fixed-to portions 141S and 1515.

As described above, the intervals between the faces positioned on mutually opposite sides of the first attachment member 126, namely between the faces 132 and the faces 133, are different for each of the three attachment intervals LA, LB and LC (FIG. 11A). Further, as described above, the intervals between the faces positioned on mutually opposite sides of the second attachment member 166, namely between the faces 172 and the faces 173, are different for each of the three attachment intervals LD, LE and LF (FIG. 11B).

Namely, in the front guide attachment section 130, either one of the first attachment member 126 or the second attachment member 166 is selected, and the orientation thereof changed such that the selected attachment interval LS, this being the interval between the fixed-to portion 141S of the front door 121 and the fixed-to portion 151S of the front guide 125, can be adjusted between the six steps of the attachment intervals LA, LB, LC, LD, LE, and LF. As described above, the selected attachment interval LS is changed between six steps in 4 mm increments.

As illustrated in FIG. 13, in the front guide attachment section 130, as the respective fixed-to portions 151S (151S0 to 151S3) on the front guide 25 side are formed in four steps, the front-rear direction position of the front guide 125 is able to be adjusted between four steps depending on the fixed-to portions 151S to which either the first attachment member 126 or the second attachment member 166 is attached.

By doing this, in the front guide attachment section 130, the front-rear direction position (namely, the attachment position) of the front guide 125 attached to the front door 121 through either the first attachment members 126 or the second attachment members 166 can be expressed by the summed values of the selected attachment interval LS and the step interval LT, similarly to in the first exemplary embodiment. The values of the attachment positions determined by the selected attachment interval LS corresponding to the orientation of the first attachment members 126 or the second attachment members 166 and the selected fixed-to portion 151S can be organized and expressed as in the attachment position adjustment table T2 illustrated in FIG. 14B corresponding to FIG. 9B.

Namely, in the front guide attachment section 130, the selected attachment interval LS can be adjusted six ways, and the step interval LT can be adjusted four ways, giving 6×4=24 ways when both are combined. Further, in the front guide attachment section 130, the selected attachment interval LS is set in increments of 4 mm, and the step interval LT is set in increments of 1 mm, such that combining the two enables the attachment position of the front guide 125 to be adjusted between 24 steps of 1 mm increments over an adjustment range of 23 mm.

2-3. Advantageous Effects, etc.

In each banknote storage box 116 of the ATM 101 according to the second exemplary embodiment with the above configuration, the front guide 125 is attached to the front door 121 through either the first attachment members 126 or the second attachment members 166 at four locations in the front guide attachment section 130.

In the front guide attachment section 130, after either one of the first attachment members 126 or the second attachment members 166 have been selected, the orientation thereof is changed as appropriate, enabling the selected attachment interval LS to be adjusted between six steps just by inserting a respective claw portion 136 or 176 into a fixing hole 142H in one of the fixed-to portions 141S on the respective front door fixing portion 140 of the front door 121.

Namely, in the front guide attachment section 130, the selected attachment interval LS can be adjusted between six steps through the use of just two members (the first attachment member 126 and the second attachment member 166), enabling a marked reduction in the number of members to be prepared compared to cases in which members are changed for each attachment position of the front guide 125.

Moreover, in the first attachment member 126 and the second attachment member 166, the claw portions 136, 137, 176, and 177 are respectively provided with ribs (FIGS. 11A, 11B). Accordingly, in the front guide attachment section 130, even in a case in which a foreign object collides with a claw portion 136 or the like, or in a case in which external force is applied to the claw portion 136 or the like, damage can be effectively prevented.

Additionally, in each front door fixing portion 140 of the front door 121, when a claw portion 136 of the first attachment member 126 or a claw portion 176 of the second attachment member 166 is hooked on a fixed-to portion 141S, a front face thereof is positioned further toward the rear side than the front face of the front door 121, and does not project out (FIGS. 14A, 14B). Accordingly, in the front guide attachment section 130, damage due to a foreign object or the like external to the banknote storage boxes 116 (FIG. 3) colliding with the claw portions 136 or the like can be forestalled.

Similarly, in each front guide fixing portion 150 of the front guide 125, when a claw portion 137 of the first attachment member 126 or a claw portion 177 of the second attachment member 166 is hooked on a fixed-to portion 151S, a rear face thereof is positioned further toward the front side than the rear face of the front guide 125, and does not project out (FIGS. 14A, 14B). Accordingly, in the front guide attachment section 130, banknotes stored in the storage space 20SC can be prevented from catching on the claw portions 137 or the like.

In other aspects, the front guide attachment section 130 is capable of exhibiting similar operation and advantageous effects to the front guide attachment section 30 according to the first exemplary embodiment.

According to the above configuration, in each banknote storage box 116 of the ATM 101 according to the second exemplary embodiment, the front guide 125 is attached to the front door 121 through either the first attachment members 126 or the second attachment members 166 at four locations in the front guide attachment section 130. The intervals between the faces 132 and 133 positioned on mutually opposite sides of the first attachment member 126 are different for each of the three attachment intervals LA, LB, and LC. Moreover, the intervals between the faces 172 and 173 positioned on mutually opposite sides of the second attachment member 166 are different for each of the three attachment intervals LD, LE, and LF. Accordingly, in the front guide attachment section 130, the selected attachment interval LS is able to be adjusted between six steps by just selecting either the first attachment members 126 or the second attachment members and changing the orientation thereof.

3. Other Exemplary Embodiments

Note that in the first exemplary embodiment described above, explanation was given regarding a case in which the attachment member 26 is configured in a rectangular block shape, resulting in three pairs of faces 32 and 33 positioned on opposite sides of the attachment member 26 to each other. The attachment intervals LA, LB, and LC, these being the respective intervals therebetween, are different from each other, and these elements are all utilized when the front guide 25 is attached to the front door 21 (FIG. 5 and FIGS. 9A, 9B). However, the present invention is not limited thereto, and for example, in cases in which adjustment of the attachment position of the front guide 25 is only desired over a comparatively narrow range, configuration may be made so as to utilize only some of the three pairs of side walls 32 and 33, for example only two pairs. Similar also applies to the second exemplary embodiment.

In the first exemplary embodiment described above, explanation was also given regarding a case in which the attachment member 26 is configured in a rectangular block shape (FIG. 5). However, the present invention is not limited thereto, and for example, the attachment member 26 may be configured in a variety of three-dimensional shapes having two or more combinations of faces positioned on opposite sides to each other, such as a tetrahedron or an octahedron. In such case, it is sufficient that the respective attachment intervals are different from each other. Similar also applies to the second exemplary embodiment.

In the first exemplary embodiment described above, explanation was also given regarding a case in which in the front guide attachment section 30, the claw portions 36 are provided to the faces 32 of the attachment member 26, and a claw portion 36 is inserted into and hooked on a fixing hole 42H provided to a fixed-to portion 41S on a front door fixing portion 40 of the front door 21 to fix the attachment member 26 to the front door 21. However, the present invention is not limited thereto, and various known shapes and mechanisms may be utilized to fix the attachment member 26 to the front door 21.

Figure 15A:
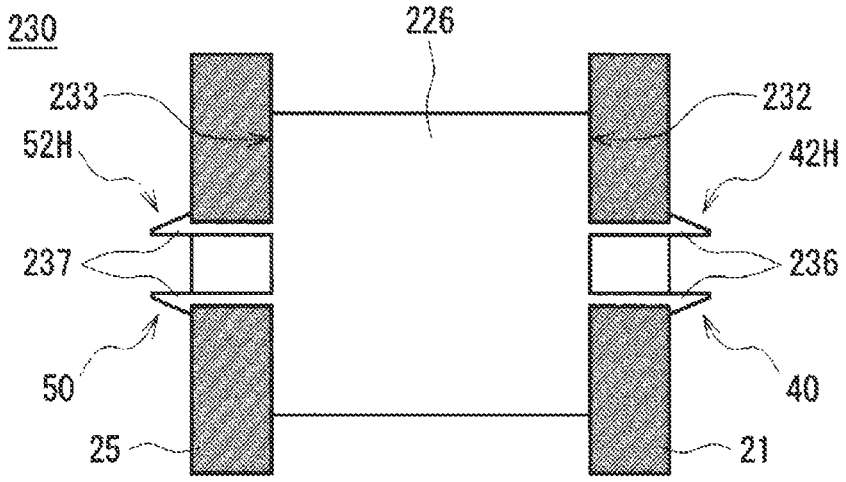
FIG. 15A is a schematic diagram illustrating configuration of a claw portion and a fixed-to portion according to another exemplary embodiment.

For example, two claw portions 236 extending along a normal direction may be provided to a face 232 of an attachment member 226 as in a front guide attachment section 230 illustrated in FIG. 15A. In such a case, the two claw portions 236 are inserted through the fixing hole 42H of the front door fixing portion 40 while elastically deforming, and an interval between leading end portions is widened following insertion, enabling the attachment member 226 to be fixed to the front door 21. Similarly, at the front guide fixing portion 50 side of the front guide 25, two claw portions 237 may similarly be provided to a face 233 of the attachment member 226. The claw portions 237 are inserted through the fixing holes 52H to enable fixing.

Figure 15B:
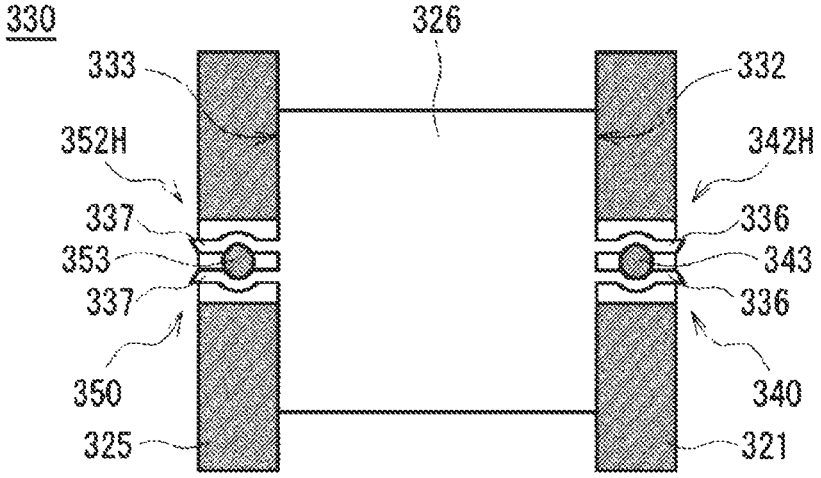
FIG. 15B is a schematic diagram illustrating configuration of a claw portion and a fixed-to portion according to another exemplary embodiment.

Further, a slender, circular column shaped engagement column 343 running along the left-right direction may be provided inside a fixing hole 342H of a front door fixing portion 340, and two claw portions 336 extending along a normal direction may be provided to a face 332 of an attachment member 326, with a portion of the claw portions 336 being curved to fit a peripheral face of the engagement column 343, as in a front guide attachment section 330 illustrated in FIG. 15B. In such a case, the two claw portions 336 are inserted through the fixing hole 342H of the front door fixing portion 340 while elastically deforming, and the engagement column 343 is gripped between the claw portions 336 following insertion, enabling the attachment member 326 to be fixed to a front door 321. Similarly, at a front panel fixing portion 350 of a front panel 325, an engagement column 353 may be provided inside a fixing hole 352H, and two claw portions 337 may be provided to a face 333 of the attachment member 326. The two claw portions 337 are inserted through the fixing hole 352H and grip the engagement column 353 to enable fixing.

Figure 15C:
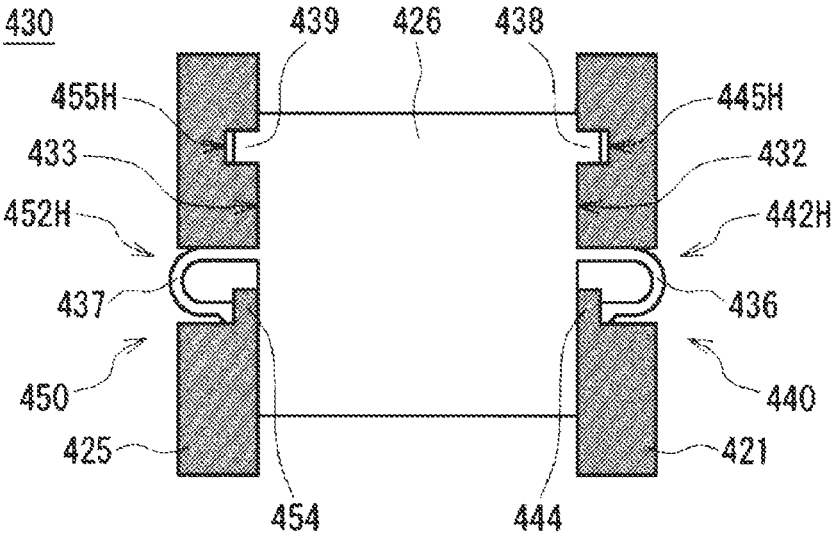
FIG. 15C is a schematic diagram illustrating configuration of a claw portion and a fixed-to portion according to another exemplary embodiment.

Additionally, a claw portion 436 shaped like a sideways English letter "U", as seen from the left and right sides, may be provided to a face 432 of an attachment member 426, and a small, column shaped positioning projection 438 may be provided at a location somewhat further toward the upper side, as in a front guide attachment section 430 illustrated in FIG. 15C. In such a case, at a front door 421 side, a hook engagement portion 444 is provided inside a fixing hole 442H of a front door fixing portion 440, and a positioning hole 445H is provided at a location somewhat further toward the upper side than the fixing hole 442H. The claw portion 436 is inserted into the fixing hole 442H while elastically deforming, the positioning projection 438 is inserted into the positioning hole 445H, and a leading edge of the claw portion 436 is hooked on the hook engagement portion 444, enabling the attachment member 426 to be fixed to the front door 421. Similarly, at a front panel fixing portion 450 side of a front panel 425, a claw portion 437 and positioning projection 439 of similar shape to the claw portion 436 and a positioning projection 438 respectively, are provided to a face 433 of the attachment member 426, a hook engagement portion 454 is provided inside a fixing hole 452H, and a positioning hole 455H is provided to the upper side thereof, so as to enable fixing of the front panel 425.

Thus, in the front guide attachment section 30, various configurations can be adopted as fixing portions for fixing the attachment member 26 to the respective front door fixing portion 40. It is sufficient that in the fixing portion, the attachment member 26 can be fixed with a simple operation, and that the fixing can be released with a simple operation, for example by utilizing the elastic deformation of resin members. Alternatively, for example, a claw portion may be provided to the front door fixing portion 40 side, and a fixing hole may be provided to the attachment member 26 side. Additionally, the engagement hooks 25C of the front guide 25 and the engagement rails 21A of the front door 21 may be omitted. However, in any case, when a strong force is applied from the front guide 25 side owing to a face 32 of each attachment member 26 being caused to abut a member on the front door 21 side, for example, a fixed-to portion 41S, this being on the rear face of the mounting portion 41 (FIG. 7A), it is preferable that this force is not applied to a member with low strength, such as a claw portion. Similar applies to fixing portions for fixing the attachment member 26 to the front guide fixing portion 50, and similar also applies to the second exemplary embodiment.

In the first exemplary embodiment described above, explanation was also given regarding a case in which claw portions 36 and 37 having substantially identical shapes to each other are provided to the faces 32 and 33 of the attachment member 26. However, the present invention is not limited thereto. For example, a rib similar to that of the second exemplary embodiment may be provided to only the claw portions 36 on the face 32 sides, or claw portions having mutually different shapes may be provided to the face 32 sides and the face 33 sides, for example with different numbers or positions of ribs between the claw portions 36 and the claw portions 37, to give a configuration in which the attachment member 26 cannot be fixed in an incorrect orientation. Similar also applies to the second exemplary embodiment.

Figure 16A:
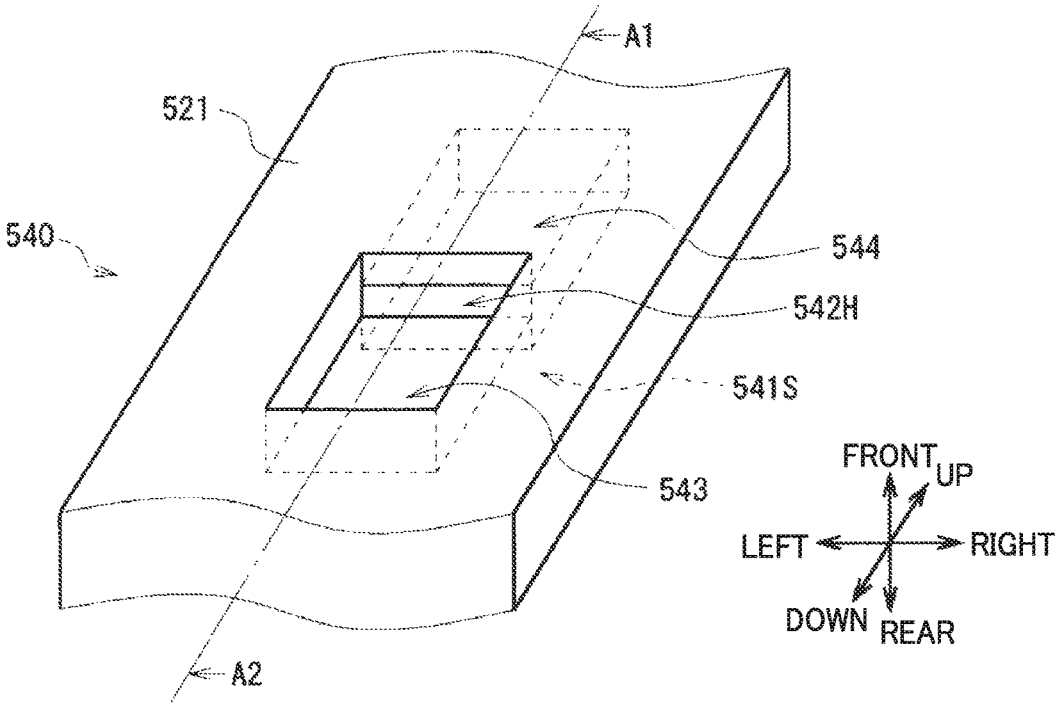
FIG. 16A is a schematic diagram illustrating configuration of a fixed-to portion according to another exemplary embodiment.
Figure 16B:
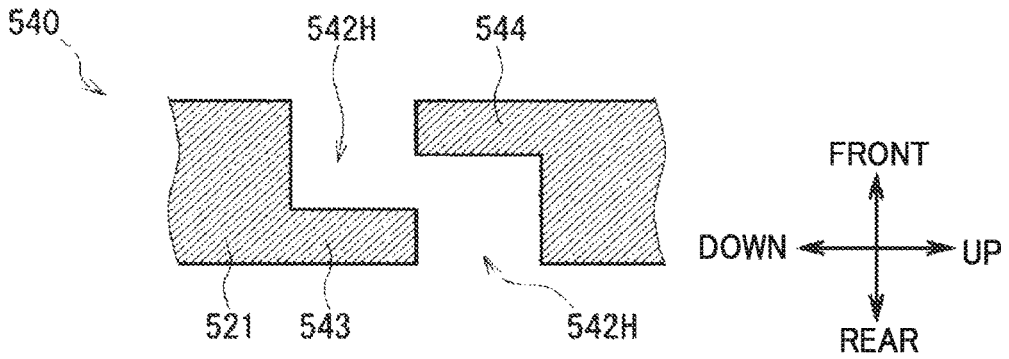
FIG. 16B is a schematic diagram illustrating configuration of a fixed-to portion according to another exemplary embodiment.
Figure 16C:
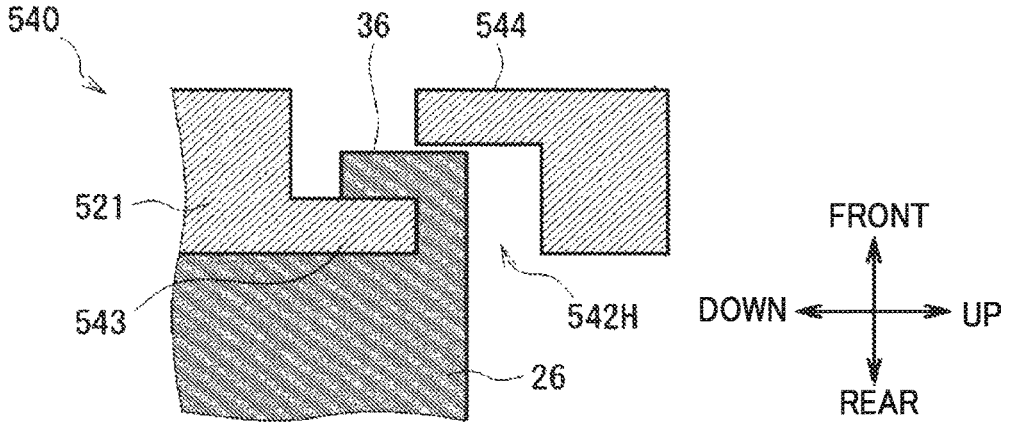
FIG. 16C is a schematic diagram illustrating configuration of a fixed-to portion according to another exemplary embodiment.

In the first exemplary embodiment described above, explanation was also given regarding a case in which the fixing holes 42H of the fixed-to portions 41S provided to each front door fixing portion 40 of the front door 21 are simple angular holes penetrating the front door 21 in the front-rear direction, and part of a claw portion 36 projects out further toward the front side than the front face 21F of the front door 21 when the claw portion 36 of the attachment member 26 is inserted into a fixing hole 42H and is hooked on a fixed-to portion 41S (FIG. 8B). However, the present invention is not limited thereto, and for example, a hook engagement portion 543 may be provided toward the rear in substantially the lower half of a fixing hole 542H, and a covering portion 544 may be provided toward the front in substantially the upper half of the fixing hole 542H, as in a front door fixing portion 540 illustrated in the perspective view of FIG. 16A and in FIG. 16B, which is a cross-section view along A1-A2 in FIG. 16A. Accordingly, it becomes more difficult to peek inside the banknote storage boxes 16 from the front side of a front door 521, though it is still possible to view the letter inscribed on the front face of the claw portion 36. Alternatively, by providing, for example, a plate shaped member to a front side portion of the front door fixing portions 40 on the front door 21, configuration may be made such that the fixing holes 42H are concealed from the front side and to not allow viewing of the claw portions 36. Similar also applies to the second exemplary embodiment.

Figure 17A:
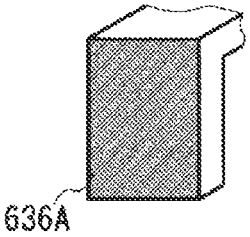
FIG. 17A is a schematic diagram illustrating configuration of a claw portion according to another exemplary embodiment.
Figure 17B:
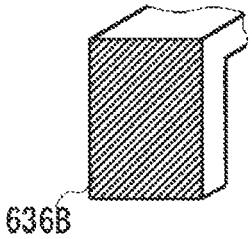
FIG. 17B is a schematic diagram illustrating configuration of a claw portion according to another exemplary embodiment.
Figure 17C:
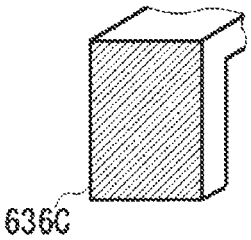
FIG. 17C is a schematic diagram illustrating configuration of a claw portion according to another exemplary embodiment.
Figure 18A:
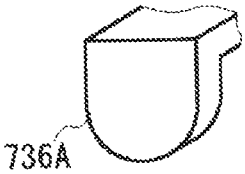
FIG. 18A is a schematic diagram illustrating configuration of a claw portion according to another exemplary embodiment.
Figure 18B:
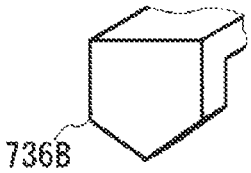
FIG. 18B is a schematic diagram illustrating configuration of a claw portion according to another exemplary embodiment.
Figure 18C:
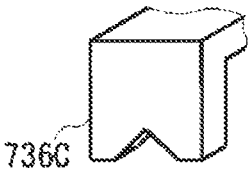
FIG. 18C is a schematic diagram illustrating configuration of a claw portion according to another exemplary embodiment.

In the first exemplary embodiment described above, explanation was also given regarding a case in which the claw portions 36 are inscribed with letters such as "A", "B", and "C" to allow a worker or the like to visually confirm the letters on a claw portion 36 from the front side of the front door 21 when the attachment member 26 has been fixed to the respective front door fixing portion 40, allowing the orientation of the attachment member 26 to be ascertained and the selected attachment interval LS to be identified (FIG. 6A to FIG. 6C, and FIG. 8B). However, the present invention is not limited thereto, and or example, inscription may be made using other letters such as "S", "M", and "L", numbers such as "1", "2", and "3", or various other designs or symbols. Additionally, mutually differing colors and patterns may be applied thereto, as in the claw portions 636A, 636B, and 636C illustrated in FIG. 17A to FIG. 17C. Alternatively, a portion of the shapes thereof may be made different, as in the claw portions 736A, 736B, and 736C illustrated in FIG. 18A to FIG. 18C. Moreover, a combination of these may be applied. In short, it is sufficient that the claw portions 36A, 36B, 36C, and the like possess mutually different visual features so as to allow identification by sight by a worker or the like. In such cases, it is even better for the features to be suggestive of the size relationship of the attachment intervals. Conversely, configuration may be made in which visual features are not provided to the claw portions 36. Similar applies to the claw portions 37, and similar also applies to the second exemplary embodiment.

For example, the claw portions 36A, 36B, and 36C may also be inscribed with the numbers "0", "7", and "14", these being the increment values from the attachment interval LA of the attachment intervals in each orientation, and the vicinity of the respective fixing holes 42H (42H0 to 42H6) in the front face of the front door 21 may be inscribed with numbers "0", "1", "2", . . . , "6" indicating the respective step intervals LT. In such a case, when viewing the vicinity of the front door fixing portions 40 from the front side of the front door 21, the attachment position of the front guide 25 can be found out by simply adding together the number of the claw portion 36 visible through the fixing hole 42H and the number inscribed in the vicinity of the fixing hole 42H into which the claw portion 36 is inserted.

In the first exemplary embodiment described above, explanation was also given regarding a case in which the fixed-to portions 51S provided to each front guide fixing portion 50 of the front guide 25 are disposed in a stepped shape, while the fixed-to portions 41S provided to each front door fixing portion 40 of the front door 21 are disposed in a planar shape (FIG. 7A and FIG. 7B). However, the present invention is not limited thereto, and for example, the fixed-to portions 51S provided to each front guide fixing portion 50 may be disposed in a planar shape while the fixed-to portions 41S provided to each front door fixing portion 40 may be disposed in a stepped shape, or both the fixed-to portions 51S and the fixed-to portions 41S may be disposed in stepped shapes. In short, it is sufficient that the attachment position of the front guide 25 to the front door 21 is able to differ in accordance with the fixed-to portion 51S (51S0 to 51S6) and the fixed-to portion 41S (41S0 to 41S6) to which the attachment member 26 is fixed. Alternatively, configuration may be made such that both the fixed-to portions 51S and the fixed-to portions 41S are provided to single locations and are not formed with steps, such that the attachment position of the front guide 25 may only be adjusted by changing the selected attachment interval LS to the attachment interval LA, LB, or LC according to the orientation of the attachment member 26. Similar also applies to the second exemplary embodiment.

In the first exemplary embodiment described above, explanation was also given regarding a case in which the increment between the attachment intervals LA, LB, and LC of the attachment member 26 are set to a relatively large value such as 7 mm, and the interval between steps of the respective fixed-to portions 51S of each of the front guide fixing portions 50 is set to a relatively small value such as 1 mm (FIG. 9B). However, the present invention is not limited thereto, and for example, the increment between the attachment intervals LA, LB, and LC may be set to a relatively small value such as 1 mm, and the interval between steps of the respective fixed-to portions 51S may be set to a value larger than this, such as 3 mm. Similar also applies to the second exemplary embodiment.

In the first exemplary embodiment described above, explanation was also given regarding a case in which seven of the fixed-to portions 51S (51S0 to 51S6) are provided to each front guide fixing portion 50 so as to form seven steps (FIG. 7B). In the second exemplary embodiment, explanation was also given regarding a case in which four of the fixed-to portions 151S (151S0 to 151S3) are provided to each front guide fixing portion 150 so as to form four steps. However, the present invention is not limited thereto, and a freely selected number of the fixed-to portions 51S or the like may be provided to each front guide fixing portion 50 or the like. In short, it is sufficient that the desired number of steps for adjusting the attachment position of the front guide 25 (for example, 21 steps) can be realized by the combination of the number of adjustment steps for the attachment intervals of the attachment members 26 (for example, three steps) and a number of steps that accords with the number of the fixed-to portions 51S or the like (for example, seven steps).

In the first exemplary embodiment described above, explanation was also given regarding a case in which the front guide 25 is adjusted between the 21 steps of attachment positions in increments of 1 mm using the front guide attachment section 30. However, the present invention is not limited thereto, and for example, when the lengths of short edges of banknotes stored in the storage space 20SC (FIG. 3) come in discrete values with 5 mm increments, the attachment position of the front guide 25 may be adjusted in increments of 5 mm by appropriately setting the step intervals of the respective fixed-to portions 51S of each front guide fixing portion 50. In short, the attachment position of the front guide 25 may be adjusted by freely selected intervals, and these need not be uniform intervals. Similar also applies to the second exemplary embodiment.

In the exemplary embodiments described above, explanation was also given regarding a case in which the front door fixing portions 40 are provided to the front door 21 at four locations and the front guide fixing portions 50 are provided to the front guide 25 at four locations, and the front guide 25 is attached to the front door 21 using four of the attachment members 26 (FIG. 4). However, the present invention is not limited thereto, and for example, configuration may be made such that the front guide 25 is attached to the front door 21 using three or fewer, or five or more, of the attachment members 26. In such a case, it is sufficient that the number of front door fixing portions 40 on the front door 21 and the number of front guide fixing portions 50 on the front guide 25 be increased or decreased in accordance with the number of the attachment members 26. Similar also applies to the second exemplary embodiment.

Figure 19:
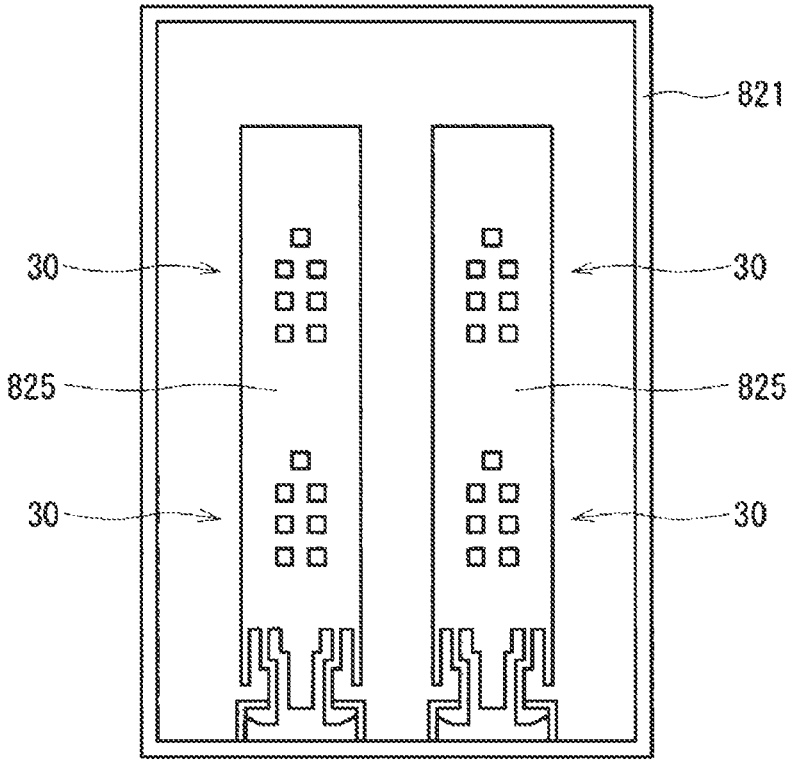
FIG. 19 is a schematic diagram illustrating configuration of a front guide according to another exemplary embodiment.

In the first exemplary embodiment described above, explanation was also given regarding a case in which the front guide 25 is configured as a single component. However, the present invention is not limited thereto, and for example, as illustrated in FIG. 19, two front guides 825 may be aligned left to right and attached to a front door 821. In short, the front guide 25 may be configured by plural components. In such a case, it is sufficient that the front guides 825 are attached to the front door 821 using at least one front guide attachment section 30 unit. Similar also applies to the second exemplary embodiment.

In the first exemplary embodiment described above, explanation was also given regarding a case in which the present invention is applied when a front guide 25 defining the front side of the storage space 20SC in the respective banknote storage box 16 is attached to a front door 21. However, the present invention is not limited thereto, and for example, the present invention may be applied to cases in which various members defining the size of a space for storing banknotes are attached to a casing or the like, such as a case in which the side guides 27 (FIG. 3) defining the left and right of the storage space 20SC are attached to the casing 20. Similar also applies to the second exemplary embodiment.

In the exemplary embodiments described above, explanation was also given regarding a case in which the present invention is applied to the banknote storage boxes 16 storing banknotes. However, the present invention is not limited thereto, and for example, application may be made to various locations that include a storage space for internally storing banknotes, and in which the size of the storage space is adjusted to match the size of stored banknotes, such as the reject box 17 or the pay-in/pay-out section 12.

In the first exemplary embodiment described above, explanation was also given regarding a case in which the present invention is applied to the banknote storage boxes 16 that store banknotes in the banknote pay-in/pay-out device 10 of the ATM 1 that performs transaction processing related to banknotes, serving as a medium, with a customer. However, the present invention is not limited thereto, and, for example, the present invention may be applied to various locations where a medium is stored in various devices that handle various paper sheet shaped media such as cash vouchers, securities, admission tickets, passenger tickets, or the like. Similar also applies to the second exemplary embodiment.

The present invention is not limited to the respective exemplary embodiments described above and the other exemplary embodiments described above. Namely, the present invention encompasses application to exemplary embodiments appropriately combining elements of some or all of the respective exemplary embodiments described above and the other exemplary embodiments described above, and exemplary embodiments deriving from elements thereof.

In the first exemplary embodiment described above, explanation was also given regarding a case in which the banknote storage box 16 serving as a medium storage device is configured by the front door 21 serving as a base body, the front guide 25 serving as a defining body, and the attachment member 26 serving as an attachment member; and in which the attachment member is configured by the faces 32 and the claw portions 36 serving as base body fixing portions and the faces 33 and the claw portions 37 serving as defining body fixing portions. However, the present invention is not limited thereto, and configuration may be made such that the medium storage device is configured by a base body, a defining body, and an attachment member of various other configurations; and such that the attachment member is configured by base body fixing portions and defining body fixing portions of various other configurations.

In the first exemplary embodiment described above, explanation was also given regarding a case in which the ATM 1 serving as a medium transaction device is configured by the conveyance section 13 serving as a conveyance section and the banknote storage box 16 serving as a medium storage device; in which the medium storage device is configured by the front door 21 serving as a base body, the front guide 25 serving as a defining body, and the attachment member 26 serving as an attachment member; and in which the attachment member is configured by the faces 32 and the claw portions 36 serving as base body fixing portions and the faces 33 and the claw portions 37 serving as defining body fixing portions. However, the present invention is not limited thereto, and configuration may be made such that the medium transaction device is configured by a conveyance section and a medium storage device of various other configurations; the medium storage device is configured by a base body, a defining body, and an attachment member of various other configurations; and such that the attachment member is configured by base body fixing portions and defining body fixing portions of various other configurations.

INDUSTRIAL APPLICABILITY

The present invention may, for example, be employed in an ATM that performs transactions relating to banknotes with a customer.

The disclosure of Japanese Patent Application No. 2015-091916, filed Apr. 28, 2015, is incorporated in its entirety by reference herein.

The invention claimed is:

1. A medium storage device comprising:

a base body;

a defining body that defines a size in a predetermined defined direction of a storage space for storing a medium;

an engagement structure including a first engagement member on the base body and a second engagement member on the defining body, the engagement structure configured to restrict movement of the defining body in a first direction relative to the base body; and an attachment member that attaches the defining body to the base body, the attachment member including a plurality of base body fixing portions that are fixable to the base body, and a plurality of defining body fixing portions that are provided at positions separated from the respective base body fixing portions by mutually different attachment intervals in mutually different attachment directions, and that are fixable to the defining body, wherein one of the base body fixing portions and one of the defining body fixing portions provided on an opposite side of the attachment member from the one of the base body fixing portions are respectively fixed to the base body and the defining body, wherein the one base body fixing portion of the attachment member is a claw portion standing out from a first surface of the attachment member and having an end that points along an intersection direction intersecting the predetermined defined direction, wherein the one defining body fixing portion of the attachment member is a claw portion standing out from a second surface of the attachment member opposite the first surface, and having ends that point along an opposite-intersection direction that is opposite to the intersection direction, and wherein the engagement structure restricts movement of the defining body in the opposite-intersection direction with respect to the base body.

2. The medium storage device of claim 1, wherein:

the base body includes a plurality of fixed-to portions to which the base body fixing portions of the attachment member are fixed;

the defining body includes a plurality of fixed-to portions to which the defining body fixing portions of the attachment member are fixed; and the fixed-to portions of at least one of the base body or the defining body have mutually differing respective positions in the predetermined defined direction.

3. The medium storage device of claim 2, wherein at least one of the base body or the defining body allows part of the attachment member to be seen at an opposite face that is opposite to a fixing face of the fixed-to portions to which the attachment member is fixed.

4. The medium storage device of claim 3, wherein the attachment member includes a visual feature that differs for each of the attachment intervals at a portion seen at the opposite face of the fixed-to portion.

5. The medium storage device of claim 1, wherein at least one of the base body and the defining body includes a fixing hole, wherein a portion of the first surface or second surface, respectively, of the attachment member surrounding the one base body fixing portion or the one defining body fixing portion, respectively, bears force when the at least one of the base body and the defining body, respectively, presses against the attachment portion in the predetermined defined direction, and wherein at least one of the one base body fixing portion or the one defining body fixing portion, respectively, restricts movement of the attachment member in the intersection direction intersecting the defined direction based on engaging the fixing hole.

6. The medium storage device of claim 1, further comprising a second attachment member, the second attachment member including:

a plurality of second base body fixing portions that are fixable to the base body; and a plurality of second defining body fixing portions that are provided at positions separated from the respective second base body fixing portions by mutually different second attachment intervals in mutually different attachment directions, and that are fixable to the defining body, wherein at least one of the plurality of second attachment intervals being different from every one of the attachment intervals of the attachment member.

7. A medium transaction device comprising:

a conveyance section that conveys a medium that is transacted with a user; and a medium storage device that stores the medium conveyed by the conveyance section, wherein:

the medium storage device includes:

a base body;

a defining body that defines a size in a predetermined defined direction of a storage space for storing the medium;

an engagement structure including a first engagement member on the base body and a second engagement member on the defining body, the engagement structure configured to restrict movement of the defining body in a first direction relative to the base body; and an attachment member that attaches the defining body to the base body;

wherein the attachment member includes:

a plurality of base body fixing portions that are fixable to the base body; and a plurality of defining body fixing portions that are provided at positions separated from the respective base body fixing portions by mutually different attachment intervals in mutually different attachment directions, and that are fixable to the defining body, wherein one of the base body fixing portions and one of the defining body fixing portions provided on an opposite side of the attachment member from the one of the base body fixing portions are respectively fixed to the base body and the defining body, wherein the base body fixing portions of the attachment member are claw portions standing out along the intersection direction, wherein the defining body fixing portions of the attachment member are claw portions standing out along an opposite-intersection direction that is opposite to the intersection direction, and wherein the engagement structure restricts movement of the defining body in the opposite-intersection direction with respect to the base body.

* * * * *